US008274540B2

(12) United States Patent
Tamaru et al.

(10) Patent No.: US 8,274,540 B2
(45) Date of Patent: Sep. 25, 2012

(54) IMAGE FORMING APPARATUS INCLUDING POSITIONING MEMBER FOR EXPOSURE UNIT

(75) Inventors: Yasuo Tamaru, Nagoya (JP); Junichi Yokoi, Toyoake (JP); Yosuke Sugiyama, Gifu (JP); Toshio Sakai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 147 days.

(21) Appl. No.: 12/547,844

(22) Filed: Aug. 26, 2009

(65) Prior Publication Data

US 2010/0054813 A1 Mar. 4, 2010

(30) Foreign Application Priority Data

Aug. 26, 2008 (JP) ..... 2008-216574
Aug. 26, 2008 (JP) ..... 2008-216581

(51) Int. Cl.
*B41J 2/45* (2006.01)

(52) U.S. Cl. ..... 347/238

(58) Field of Classification Search ..... 347/238, 347/245, 263, 230, 241–244, 256–258
See application file for complete search history.

(56) References Cited

U.S. PATENT DOCUMENTS 5,612,767 A * 3/1997 Iwama ..... 399/98
5,978,626 A 11/1999 Nagamine et al.
6,995,782 B2 * 2/2006 Oda et al. ..... 347/138

FOREIGN PATENT DOCUMENTS

JP H3-129962 12/1991
JP 11-153893 6/1999
JP 2006084636 A * 3/2006
JP 2008-018700 1/2008

OTHER PUBLICATIONS

Notice of Reasons for Rejection for Japanese Patent Application No. 2008-216574 mailed Aug. 17, 2010.
Notice of Reasons for Rejection for Japanese Patent Application No. 2008-216581 mailed Aug. 17, 2010.

* cited by examiner

*Primary Examiner* — Hai C Pham
(74) *Attorney, Agent, or Firm* — Banner & Witcoff, Ltd.

(57) ABSTRACT

An image forming apparatus includes a photoconductive body on which an electrostatic latent image is formed, an exposure unit which exposes the photoconductive body, a first pressing member which presses the exposure unit toward the photoconductive body, a first positioning member which makes a contact with the exposure unit, a second positioning member which is arranged at a side nearer to the photoconductive body than the first positioning member in an optical axial direction of light, and a second pressing member which presses the exposure unit toward the second positioning member. A point of action at which the first pressing member presses the exposure unit is positioned at a side nearer to the photoconductive body, than the first positioning member in the optical axial direction. It is possible to suppress a degradation of an image quality by suppressing an effect of vibrations with respect to the exposure unit.

6 Claims, 14 Drawing Sheets

16
45
112
140
122
43
53
40
46
46D
45A
O3
O4
$F_F$
$F_R$

IMAGE FORMING APPARATUS INCLUDING POSITIONING MEMBER FOR EXPOSURE UNIT

CROSS REFERENCE TO RELATED APPLICATION

The present application claims priority from Japanese Patent Application No. 2008-216574, filed on Aug. 26, 2008, and Japanese Patent Application No. 2008-216581, filed on Aug. 26, 2008, the disclosure of which are incorporated herein by reference in their entirety.

BACKGROUND OF THE INVENTION

1. Field of the Invention

The present invention relates to an image forming apparatus in which a photoconductive body is exposed at a position adjacent to the photoconductive body by an exposure unit having a plurality of blinking sections.

2. Description of the Related Art

Generally, as an exposure unit which is used in an image forming apparatus such as a printer, an exposure unit (such as an LED head) which includes a plurality of blinking sections (such as LEDs) arranged in a row, and in which a photoconductive body (photosensitive body) is exposed at a position adjacent to the photoconductive body has been known (for example, refer to FIGS. 2 and 3 of Japanese Patent Application Laid-open No. 2008-18700).

Such exposure unit is pressed toward the photoconductive body by a pressing member such as a coil spring, in an optical axial direction of light which is irradiated from the blinking portion. Moreover, the exposure unit is brought into contact with at least two planar shaped positioning members to be positioned in a movement direction of the photoconductive body, in order to suppress wobbling (oscillating) in a movement direction of a portion of the photoconductive body facing the exposure unit.

Moreover, in an image forming apparatus shown in FIGS. 1 and 2 of Japanese Patent Application Laid-open No. H11-153893, an LED head (an optical head) is installed on a top cover (a top frame). The top cover is pivotable (rotatable) around a predetermined axis. When the top cover is turned to close (or to open) an upper surface of an image forming apparatus, the LED head moves between an exposing position of exposing the photoconductive body and a drawn-away position of being drawn-away from the photoconductive body.

SUMMARY OF THE INVENTION

Incidentally, in an image forming apparatus, for instance, small vibrations (minute vibrations) are generated inside the image forming apparatus, due to an impact when a heavy paper makes a contact a photoconductive drum during an image formation. Due to these small vibrations, sometimes, a point of action (a point of application) at which a pressing member presses an exposure unit toward the photoconductive body is shifted in a movement direction of the photoconductive body. In other words, due to the vibrations, a force drawing the exposure unit away from a positioning member sometimes acts on the exposure unit. When the point of action of the pressing member is shifted in the movement direction of the photoconductive body to separate the exposure unit away from the positioning member, a position of the exposure unit with respect to the photoconductive body changes. The change in the position of the exposure unit with respect to the photoconductive body becomes a cause of degradation of an image quality.

Incidentally, it is desirable that the exposure unit such as an LED head is biased toward one of the directions of movement of a photosensitive-body surface facing the exposure unit, for positioning the LED head with respect to the photoconductive body. When the exposure unit moves from a drawing-away position to an exposing position, it is necessary to move the exposure unit at a position close to the photoconductive body, resisting a bias applied in a direction substantially orthogonal to a movement direction of the exposure unit. Therefore, there is a fear that the exposure unit cannot be moved up to the exposing position due to a resistance by the bias.

In view of the abovementioned circumstances, an object of the present invention is to provide an image forming apparatus in which it is possible to suppress a degradation of an image quality by suppressing an effect of vibrations on the exposure unit, and to provide an image forming apparatus in which it is possible to position accurately the exposure unit with respect to the photoconductive body, by reducing a resistance at the time of moving the exposure unit.

According to a first aspect of the present invention, there is provided an image forming apparatus including a photoconductive body on which an electrostatic latent image is formed;

an exposure unit including a plurality of blinking sections each of which emits a light to expose the photoconductive body;

a first pressing member which presses the exposure unit toward the photoconductive body;

a first positioning member which is brought into contact with the exposure unit to position the exposure unit in a movement direction of a portion, of the photoconductive body, facing the exposure unit;

a second positioning member which is arranged closer to the photoconductive body than the first positioning member in an optical axis direction of the light, which makes a contact with the exposure unit, and which positions the exposure unit in the movement direction; and a second pressing member which presses the exposure unit toward the second positioning member, wherein a point of action at which the first pressing member presses the exposure unit is located at a position closer to the photoconductive body than the first positioning member in the optical axis direction.

According to the image forming apparatus according to the first aspect of the present invention, the point of action at which the first pressing member presses the exposure unit is positioned at the side nearer to the photoconductive body, than the first positioning member in the optical axial direction. Therefore, even when the point of action is shifted in any of the directions of movement of the photoconductive body due to the vibrations, it is possible to suppress an action (effect of vibrations) of the exposure unit being drawn away from the positioning member.

Concretely, when a force separating away from the positioning member is exerted to the exposure unit upon shifting of the point of action, for instance, the exposure unit is supported by the first positioning member and/or the second positioning member. Accordingly, it is possible to stabilize a position of the exposure unit with respect to the photoconductive body. Moreover, due to a pressing force of the second pressing member, the exposure unit is regulated (is restricted) from separating away from the positioning member. Accordingly, it is possible to stabilize the position of the exposure unit with respect to the photoconductive body. Furthermore, since a distance between the point of action and a pivot center (a supporting point) when the force drawing away has acted on the exposure unit from the positioning member is short (close), a comparatively substantial force is necessary for pivoting (moving) the exposure unit. Therefore, it is possible to stabilize the position of the exposure unit with respect to the photoconductive body, for a small force due to the minute vibrations.

According to a second aspect of the present invention, there is provided an image forming apparatus including a photoconductive body on which an electrostatic latent image is formed;

an exposure unit having a plurality of blinking sections each of which emits a light to expose the photoconductive body;

a first pressing member which presses the exposure unit toward the photoconductive body;

a positioning member which has a predetermined length in an optical axis direction of the light, and which is brought into a surface-contact with the exposure unit, which positions the exposure unit in a movement direction of a portion, of the photoconductive body, facing the exposure unit; and a second pressing member which is arranged at a position facing the positioning member, with the exposure unit being intervened between the second pressing member and the positioning member, and which presses the exposure unit toward the positioning member, wherein a point of action at which the first pressing member presses the exposure unit overlaps with an area, of the exposure unit, in which the positioning member is brought into surface-contact with the exposure unit, as viewed in the movement direction.

According to the second aspect of the present invention, the point of action at which the first pressing member presses the exposure unit is positioned within the range of the outer frame of the area of the surface contact of the exposure unit and the fourth positioning member, when viewed from the movement direction. Therefore, even when the point of action is shifted in the movement direction of the photoconductive body due to vibrations, it is possible to suppress an action (effect of vibrations) of the exposure unit being drawn away from the positioning member.

Concretely, when a force separating away (the exposure unit) from the positioning member has acted on the exposure unit upon shifting of the point of action, on one hand, the exposure unit is supported by the fourth positioning member. Therefore, it is possible to stabilize the position of the exposure unit with respect to the photoconductive body. Moreover, on the other hand, since the exposure unit is regulated (is restricted) from separating away from the positioning member by a pressing force of the second pressing member, it is possible to stabilize the position of the exposure unit with respect to the photoconductive body.

According to a third aspect of the present invention, there is provided an image forming apparatus including a photoconductive body on which an electrostatic latent image is formed;

an exposure unit which has an elongated shape, and which is movable between an exposing position at which the exposure unit exposes the photoconductive body, and a separate-away position to which the exposure unit is separated away from the photoconductive body than the exposing position, the exposure unit having guiding portions each of which is extended in a movement direction from the exposing position to the separate-away position, and which are arranged on both sides in a longitudinal direction of the exposure unit;

a body frame which is arranged with respect to the both sides in the longitudinal direction of the exposure unit, and to which the exposure unit is attached; and a turnable arm which is turnably supported by the body frame, and is biased in a bias direction approaching toward the exposure unit, the turnable arm including a shaft portion which is supported by the body frame to serve as a supporting point for a turning movement of the turnable arm, and an arm portion which is extended from the shaft portion toward the separate-away position in the movement direction, the arm portion having a contact portion which is brought into contact with the guiding portion when the exposure unit is at the exposing position, and a protruding-contact portion which protrudes in the bias direction than the contact portion at an end portion of the contact portion, wherein an accommodating portion, which accommodates the protruding-contact portion when the exposure unit is at the exposing position, is formed in the exposure unit; and a first inclined surface which is inclined with respect to the movement direction, and which is brought into sliding-contact with the protruding-contact portion when the exposure unit is installed, is formed on at least one of the protruding-contact portion and an end portion of the guiding portion, and when the exposure unit is attached to the body frame, the end portion of the guide portion is brought into contact with the protruding-contact portion, and one of the end portion and the protruding-contact portion moves, while being brought into contact with the first inclined surface, to move the turnable arm in a direction away from the exposure unit; and while the contact portion is away from the guiding portion, the guiding portion moves toward the exposing position while making a contact with the protruding-contact portion, and the contact portion is brought into contact with the guiding portion when the protruding-contact portion is accommodated by the accommodating portion.

In the image forming apparatus according to the third aspect of the present invention, when the exposure unit is mounted on the body frame, firstly, the front-end portion (guiding portion) makes a contact with the protruding-contact portion and the front-end portion or the protruding-contact portions makes a sliding contact with (on) the first inclined surface. Accordingly, the exposure unit moves the turnable arm in a direction of drawing away from the exposure unit. Moreover, with the contact portion in a state of being drawn away from the guiding portion, the guiding portion moves (goes on moving) toward the exposing position while making a sliding contact with the protruding-contact portion. Thereafter, when the accommodating portion accommodates (receives) the protruding-contact portion, the contact portion and the guiding portion apply a bias to the exposure unit.

When the exposure unit is attached to the body frame, the guiding portion makes a contact with the protruding-contact portion toward the front end which is farther away from the shaft portion, and moves (pivots) the turnable arm in a direction of drawing away from the exposure unit. Therefore, as compared to a case of moving (pivoting) the turnable arm by the exposure unit making a contact with a portion near the shaft portion, it is possible to move (pivot) the turnable arm with a weak force. Accordingly, a resistance by the bias which acts on the guiding portion (exposure unit) from the turnable arm when the exposure unit moves to the exposing position while the guiding portion making a sliding contact with the protruding-contact portion becomes small.

When the exposure unit moves to the exposing position while the guiding portion making a sliding contact with the protruding-contact portion, the contact portion is drawn away from the guiding portion. Therefore, no bias acts on the guiding portion (exposure unit) from the contact portion. Consequently, it is possible to make small (decrease) a resistance at the time of moving the exposure unit to the exposing position, and it is possible to move the exposure unit assuredly up to the exposing position (a position adjacent to the photoconductive body).

According to the image forming apparatus of the present invention, since it is possible to suppress the effect of vibrations on the exposure unit and to stabilize the position of the exposure unit with respect to the photoconductive body, as a result, it is possible to suppress a degradation of an image quality.

According to the image forming apparatus of the present invention, since it is possible to make small the resistance at the time of moving the exposure unit, and to move the exposure unit assuredly up to the exposing position, it is possible to determine accurately the position of the exposure unit with respect to the photoconductive body.

BRIEF DESCRIPTION OF THE DRAWINGS

FIGS. 4A, 4B, and 4C are diagrams for explaining an action of a first embodiment, wherein FIG. 4A shows an example in which a point of action of a pressing spring is positioned between a first positioning member and a second positioning member, FIG. 4B shows an example for comparison when the point of action of the pressing spring is positioned at an upper side of the first positioning member, and FIG. 4C shows a modified example when the point of action of the pressing spring is positioned at a lower side of the second positioning member;

FIGS. 7A, 7B, and 7C are diagrams for explaining an action of the second embodiment, wherein FIG. 7A shows an example in which a point of action of a pressing spring is positioned between a first positioning member and a second positioning member, FIG. 7B shows a first example for comparison in which the point of action of the pressing spring is positioned at an upper side of the first positioning member, and FIG. 7C shows a second example for comparison in which the point of action of the pressing spring is positioned at a lower side of the second positioning member;

FIGS. 12A, 12B, and 12C are diagrams for explaining an action of the turnable arm at the time of installing the LED unit, wherein, FIG. 12A shows as to how the turnable arm is moved in a direction of being drawn away from the LED unit, while a guiding portion making a contact with a protruding-contact portion, FIG. 12B shows as to how the guiding portion makes a sliding contact with the protruding-contact portion, and FIG. 12C shows as to how the turnable arm is moved toward the LED unit;

FIGS. 14A and 14B are diagrams for explaining an action of the turnable arm at the time of mounting the LED unit of the fifth embodiment, wherein, FIG. 14A shows as to how the turnable arm is moved in a direction of being drawn away from the LED unit, while a guiding portion making a contact with a protruding-contact portion, and FIG. 14B shows as to how the guiding portion makes a sliding contact with the protruding-contact portion.

DETAILED DESCRIPTION OF THE PREFERRED EMBODIMENTS

First Embodiment

Figure 1:
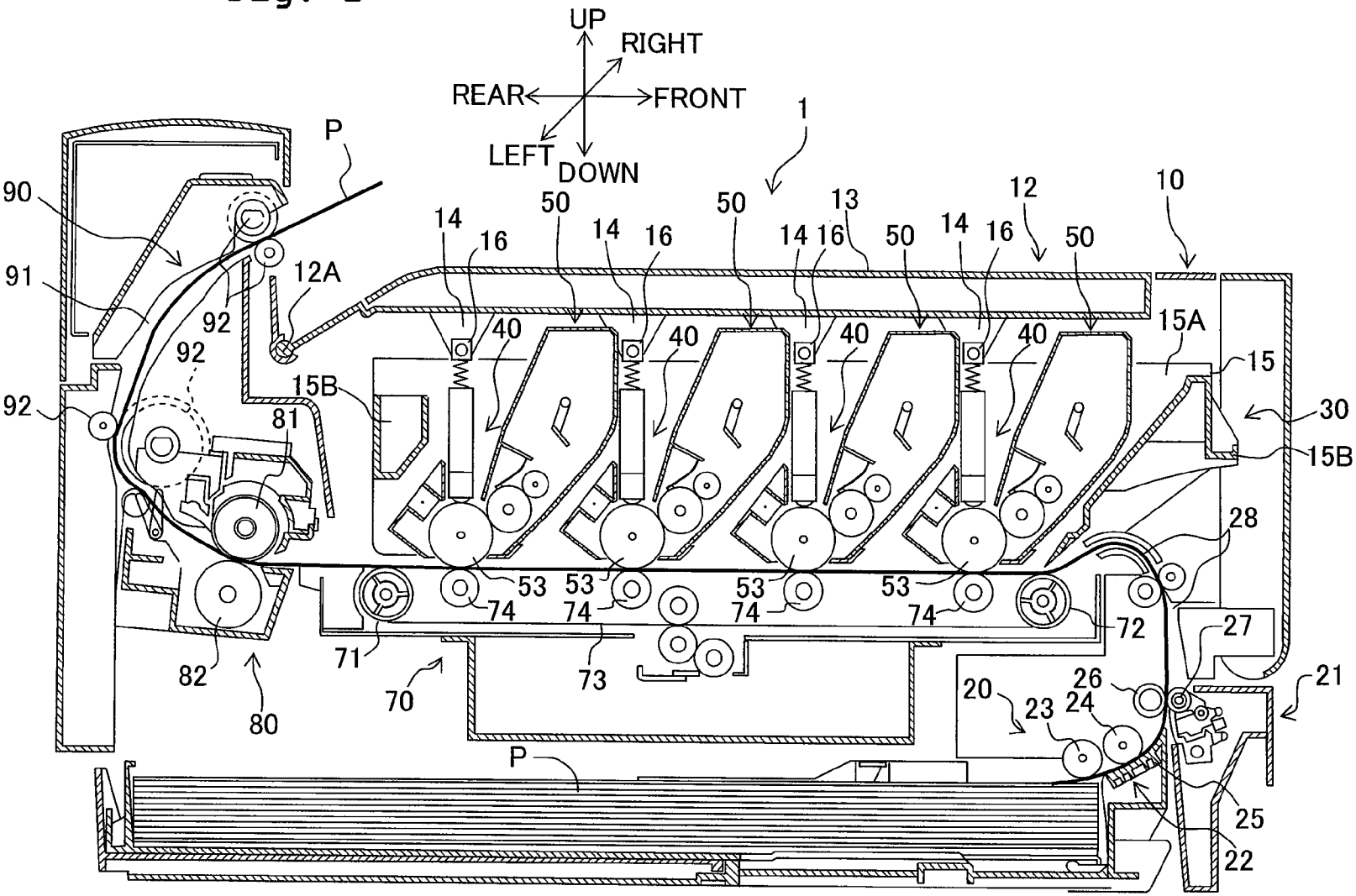
FIG. 1 is a cross-sectional view showing an overall structure of a color printer as an example of an image forming apparatus.

Exemplary embodiments of the present invention will be described below in detail with reference to the diagrams. FIG. 1 is a cross-sectional view showing an overall structure of a color printer 1 as an example of an image forming apparatus.

In the following description, directions are assigned according to a user using the color printer, as a base. In other words, in FIG. 1, a right side and a left side of a paper surface are assigned as a 'front' side and a 'rear' side respectively, and a frontward side and a rearward side in a direction perpendicular to the paper surface, are assigned as a 'left' side and a 'right' side respectively. Moreover an upper direction and a lower direction of the paper surface are assigned as a 'vertical' (an 'upper and lower') direction.

As shown in FIG. 1, the color printer 1 includes mainly, a body (a body casing) 10, a paper feeding section 20 which supplies papers P (recording sheets), an image forming section 30 which forms an image on the paper P, and a paper discharge section 90 which discharges the paper P having an image formed thereon.

A top cover 12 which is pivotable upward and downwards around a pivot shaft 12A provided at a rear side, and which openably covers an upper portion of the body 10 is provided to the upper portion of the body 10. An upper surface of the top cover 12 serves as a paper discharge tray 13 which accumulates the papers P discharged from the body 10, and a plurality of LED installing portions 14 which support a LED unit 40 (exposure unit) is provided to a lower surface of the top cover 12.

Moreover, a body frame 15 which detachably accommodates a plurality of process cartridges 50 that will be described later, is provided inside the body 10. The body frame 15 includes a pair of side frames 15A (only one side shown in FIG. 1) made of a metallic material, facing in a left-right direction, and a cross member 15B provided at a front and a rear side of the side frames 15A to connect them. The body frame 15 is fixed to the body 10 etc.

The paper feeding section 20 includes mainly, a paper feeding tray 21 which is detachably installed on the body 10, and a paper supplying mechanism 22 which supplies the papers P from the paper feeding tray 21 to the image forming section 30. The paper supplying mechanism 22 is provided at a front side of the paper feeding tray 21, and includes mainly, a paper feeding roller 23, a separating roller 24, and a separating pad 25.

In the paper feeding section 20, the papers P in the paper feeding tray 21 are sent upward one-by-one by the paper supplying mechanism 22 upon being separated. Paper dust is removed when the paper P passes between a paper-dust removing roller 26 and a pinch roller 27. Then a direction of the paper P is changed to be rearward while the paper P passes through a transportation path 28, and the paper is supplied to the image forming section 30.

The image forming section 30 includes mainly, four LED units 40 as an example of exposure units, four process cartridges 50, a transfer unit 70, and a fixing unit 80.

The LED unit 40 is arranged to face a cylindrical shaped photoconductive drum 53 (photoconductive body) at an upper side of the photoconductive drum 53, and exposes a surface of the photoconductive drum 53. The LED units 40 are supported by the LED installing portions 14 (top cover 12) via holders 16, respectively, and are positioned appropriately by members such as first positioning members 110 and second positioning members 120 which will be described later. At the time of turning the top cover 12 upward, the four LED units 40 moves from a position adjacent to the photoconductive drum 53, to a position away from the photoconductive drum 53 (not shown in the diagrams). A detail structure of the LED units 40 will be described later.

The process cartridges 50 are arranged in line in a front-rear direction between the top cover 12 and the paper feeding section 20, and include components such as a photoconductive drum 53 as an example of a photoconductive body on which an electrostatic latent image is formed, a hitherto known charger, a developing roller, a supply roller, and a toner receptacle which are shown without reference numerals.

The transfer unit 70 is provided between the paper feeding section 20 and each process cartridge 50, and includes mainly, a drive roller 71, a driven roller 72, a transporting belt 73, and a transfer roller 74.

The drive roller 71 and the driven roller 72 are arranged in parallel, to be separated in a front-rear direction, and the transporting belt 73 in the form of an endless belt is put around the drive roller 71 and the driven roller 72. An outer surface of the transporting belt 73 makes contact with the photoconductive drums 53. The four transfer rollers 74 are arranged inside the transporting belt 73 to face the photoconductive drums 53 such that the transporting belt 73 is sandwiched between the four transfer rollers 74 and the photoconductive drums 53. A transfer bias is applied to the transfer roller 74 at the time of transferring.

The fixing unit 80 is arranged at a rear side of each of the process cartridges 50 and the transfer units 70, and includes a heating roller 81 and a pressurizing roller 82 which is arranged to face the heating roller 81 and which pressurizes the heating roller 81.

In the image forming apparatus 30, firstly, the surface of each photoconductive drum 53 is charged uniformly by the charger, and then the surface is exposed by light irradiated from each LED unit 40. Accordingly, an electric potential on the surface of the photoconductive drums 53 at a portion exposed is decreased, and an electrostatic latent image based on image information is formed on the photoconductive drums 53. Thereafter, toner is supplied to the electrostatic latent image by a developing roller, and a toner image is formed on each of the photoconductive drum 53.

Next, the paper P supplied on to the transporting belt 73 passes between the photoconductive drums 53 and the transfer rollers 74 arranged at the inner side of the transporting belt 73. At this time, the toner images formed on the photoconductive drums 53 are transferred and superimposed in order on the paper P. Thereafter, when the paper P passes through the heating roller 81 and the pressurizing roller 82, the toner images transferred on to the paper P are fixed by heating (the toner images transferred on to the paper P are subjected to thermal fixing).

The paper discharge section 29 includes mainly, a paper-discharge side transportation path 91 which is formed to extend upward from an exit of the fixing unit 80, and which is formed to turn frontward, and a plurality of transporting rollers 92 which transport the paper P. The paper P with the toner image fixed by heating thereon is transported to the paper-discharge side transportation path 91, and is discharged to outside (exterior) of the body 10. The discharged paper P is accumulated in the paper discharge tray 13.

Figure 2:
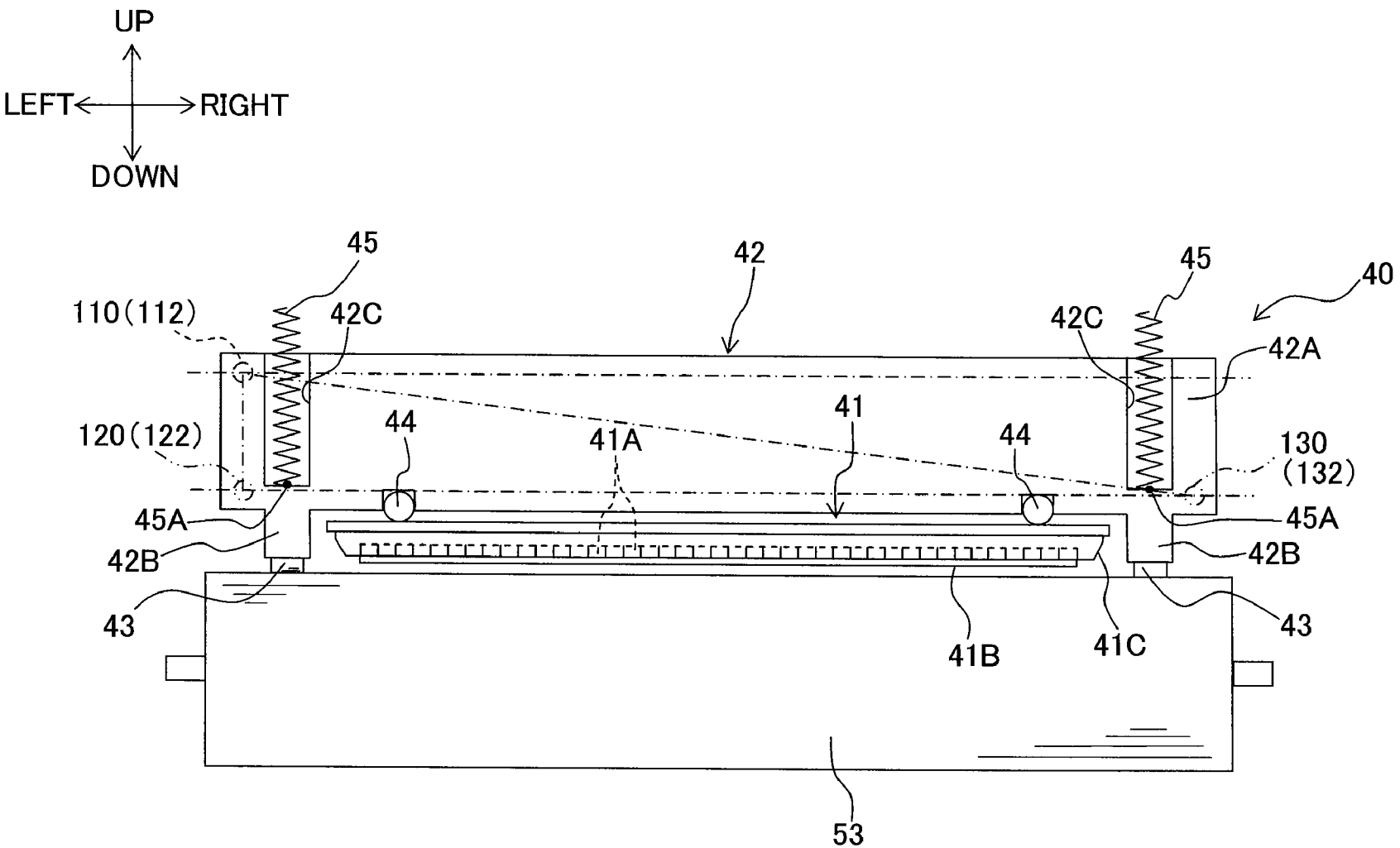
FIG. 2 is a diagram of a structure of an LED unit and other units around the LED unit viewed from a front side.
Figure 3:
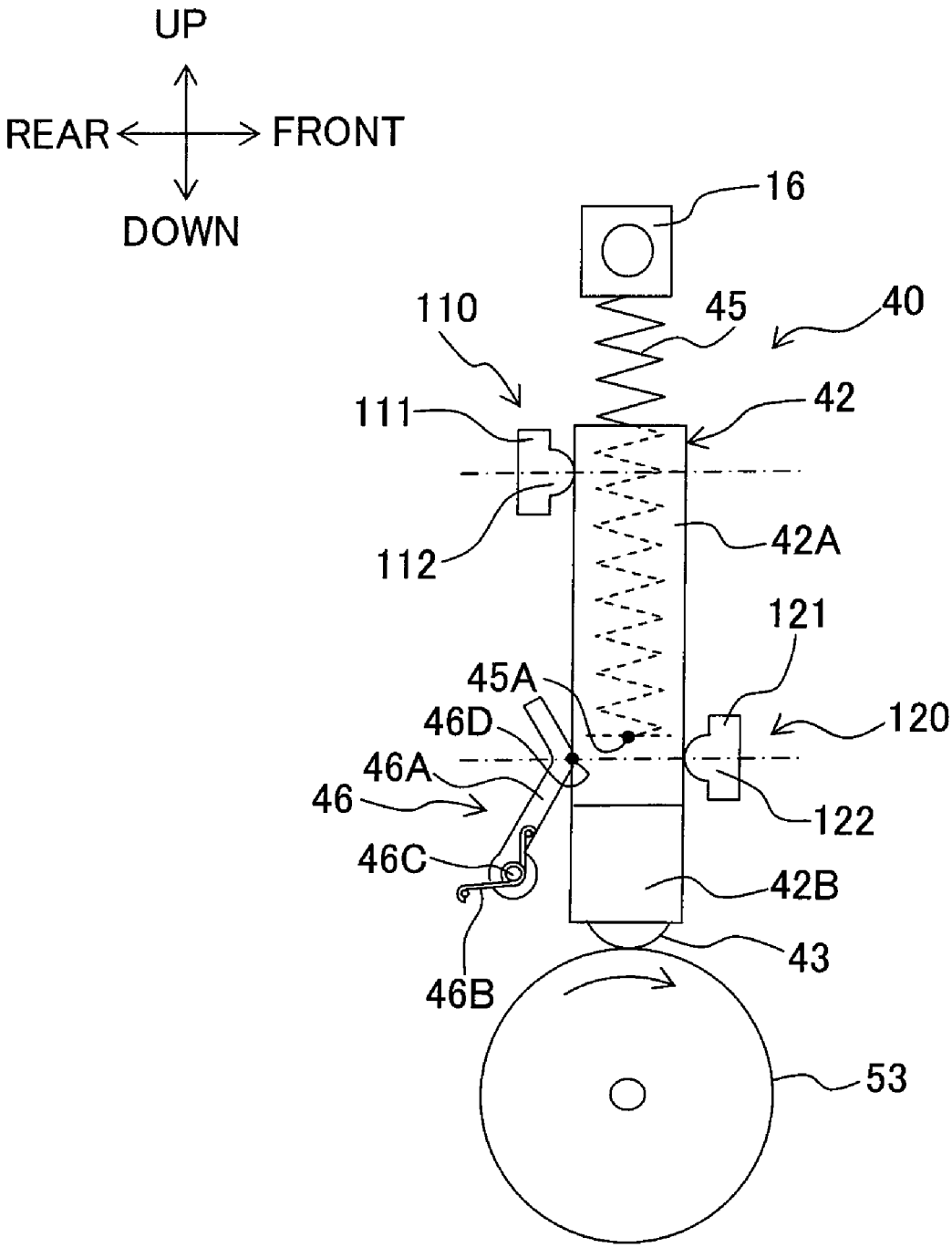
FIG. 3 is a diagram of the structure of the LED unit and the area around the LED unit viewed from a left side.

FIG. 2 is a diagram of a structure of an LED unit and other units around the LED unit viewed from a front side, and FIG. 3 is a diagram of the structure of the LED unit and other units around the LED unit viewed from a left side.

Here, in the following description, directions are determined based on a state in which the LED unit 40 shown in FIG. 1 is arranged adjacently to the photoconductive drum 53. Moreover, in the following description, an 'optical axial direction' is defined as a direction of an optical axis of light which is irradiated from the LED unit 40 (an LED head 41), and the optical axial direction coincides substantially with a vertical direction in the first embodiment. Furthermore, a 'movement direction' is defined as a movement direction of a portion of the photoconductive drum 53 facing the LED unit 40 (LED head 41), and the movement direction coincides substantially with a front-rear direction in the first embodiment.

Firstly, The structure of the LED unit 40 and the surrounding units thereof will be described below in detail. As shown in FIG. 2, the LED unit 40 includes mainly, the LED head 41 as an example of an exposing member, a supporting frame 42, two guide rollers 43, and two eccentric cams 44.

The LED head 41 includes mainly a plurality of LED arrays 41A, as an example of a plurality of blinking sections, aligned in a row in a left-right direction, a lens array 41B, and a head frame 41C made of a resin material which supports the LED arrays 41A and the lens array 41B. The LED head 41 may also have a plurality of LED arrays 41A in which each of the LED arrays 41A is extended in the left-right direction, and the plurality of LED arrays 41A are arranged, side by side, in the front-rear direction.

The LED array 41A is a semiconductor chip in which a plurality of LEDs is arranged in a row. The lens array 41B includes a GRIN lens (gradient refractive index lens) (circular cylindrical shaped lens) made of glass as an example of a distributed refractive-index lens in which a light exit surface is formed to be a flat surface. The GRIN lens is aligned in a row, and focus the light emitted from the LED array 41A on the surface of the photoconductive drum 53.

The supporting frame 42 is a member made of a resin material which supports the LED head 41 from an upper side, and is installed on the LED installing portion 14 via the holder 16 (refer to FIG. 1). The supporting frame 42 includes mainly, a frame body 42A and a roller supporting portion 42B which is extended downwards from both left and right end sides of the frame body 42A. Description of a structure of the holder 16 supporting the supporting frame 42 is omitted.

A recess 42C which is dented downwards from an upper surface, is formed at an upper side (substantially directly above) each of the roller supporting portions 42B arranged on both left and right end sides. A pressing spring 45 (compression coil spring or helical compression spring), as an example of a first pressing member, is arranged in the recess 42C. An upper end of the pressing spring 45 protrudes from an upper surface of the supporting frame 42.

The upper end of the pressing spring 45 is attached to (engaged with) the holder 16, and a lower end of the pressing spring 45 makes a contact with a bottom surface of the recess 42C. Therefore, when the pressing spring 45 is pressed and compressed, the pressing spring 45 presses the supporting frame 42 (LED unit 40) toward the photoconductive drum 5. Although it is not shown in the diagram, a wall portion provided integrally with the frame body 42A is formed at a front and rear side of the recess 42C. Accordingly, since a buckling (crippling) of the pressing spring 45 is prevented, it is possible to press the supporting frame 42 stably toward the photoconductive drum 53. The frame body 42A may be provided continuously in the vertical direction, or may be provided to be discontinuous, by forming in the form of a grating for example.

The guide roller 43 is rotatably supported at a lower end of the roller supporting portion 42B. The guide roller 43 is a sort of a space-maintaining member (gap-maintaining member), and makes a contact with the surface of the photoconductive drum 53 when the LED unit 40 is at a position adjacent to the photoconductive drum 53. Accordingly, the guide roller 43 maintains a space (a distance) between the LED head 41 and the photoconductive drum 53. A thrust from the pressing spring 45 is transmitted to the guide roller 43 via the supporting frame 42. Accordingly, the guide roller 43 is pressed against the photoconductive drum 53, and is driven and rotated by the photoconductive drum 53.

The guide roller 43 may make a contact with a photosensitive layer (a layer on which an electrostatic latent image is formed by being exposed) of the surface of the photoconductive drum 53, or may make a contact with an area, of the surface of the photoconductive drum 53, the area being located in an outer side of the photosensitive layer in the left-right direction (area with no photosensitive layer).

Here, as it has been described above, the recess 42C is formed at an upper side (substantially directly above) the roller supporting portion 42B of the frame body 42A, and the pressing spring 45 pressing the supporting frame 42 toward the photoconductive drum 53 is arranged in the recess 42C. Consequently, the guide roller 43 is pressed from substantially directly above by the pressing spring 45. Accordingly, since it is possible to minimize a deformation (such as bending) of the supporting frame 42 and the LED head 41 due to the thrust of the pressing spring 45, it is possible to stabilize a position of the LED unit 40 (more elaborately, the LED array 41A) with respect to the photoconductive drum 53.

The eccentric cam 44 is a hitherto known eccentric cam arranged between the LED head 41 and the supporting frame 42 (frame body 42A). By rotating the eccentric cam 44 appropriately, it is possible to adjust the space (distance) between the LED head 41 and the supporting frame 42 of the LED unit 40. Description in detail of a structure of the supporting frame 42 supporting the LED head 41 is omitted.

LED unit 40 is positioned with respect to the photoconductive drum 53 by the first positioning member 110, the second positioning member 120, a third positioning member 130, and a second pressing member 46. A structure of each member and a positional relationship thereof will be described below.

As shown in FIGS. 2 and 3, each of the first positioning member 110, the second positioning member 120, and the third positioning member 130 makes a contact with the supporting frame 42 (frame main 42A) of the LED unit 40. Accordingly, the first positioning member 110, the second positioning member 120, and the third positioning member 130 determine the position of the LED unit 40 in the movement direction of the photoconductive drum 53 (front-rear direction).

The first positioning member 110 is arranged at an upper portion of a left-end portion of the LED unit 40, on a rear side of the LED unit 40. In other words, the first positioning member 110 is arranged at an upper portion of one-end side in a longitudinal direction of the frame body 42A, at an upstream side in a movement direction with respect to the LED unit 40. The first positioning member 110 includes a base portion 111 in the form of a plate which is fixed to the body frame 15, or in other words, fixed to an inner surface of the side frame 15A on the left side, and a first positioning portion 112 which protrudes in the form of a substantially semispherical protrusion from a front surface of the base portion 111.

The second positioning member 120 is arranged at a left-end side of the LED unit 40 (frame body 42A), to be aligned vertically with the first positioning member 110 when viewed from the front-rear direction. More elaborately, the second positioning member 120 is arranged at a side near to the photoconductive drum 53, than the first positioning member 110 in the optical axial direction, at a front side of the LED unit 40. In other words, the second positioning member 120 is positioned at a lower side (downward) of the first positioning member 110 in the vertical direction, at a downstream side of the LED unit 40 in the movement direction.

The second positioning member 120 includes a base portion 121 in the form of a plate which is fixed to the body frame 15 (inner surface of the side frame 15A on the left side) and a second positioning portion 122 which protrudes in the form of a substantially semispherical protrusion from a rear surface of the base portion 121.

The third positioning member 130 is arranged at a position same as of the second positioning member 120 in up-down direction, at a right-end side of the LED unit 40 (frame body 42A) (the other end side in the longitudinal direction), and at a front side of the LED unit 40 same as the second positioning member 120 regarding the front-rear direction. The third positioning member 130 includes a base portion (not shown in the diagram) in the form of a plate which is fixed to the body frame 15 (inner surface of the side frame 15A on the right side), and a third positioning portion 132 which protrudes in the form of a substantially semispherical protrusion from a rear surface of the base portion.

The second pressing member 46 includes mainly, an arm portion 46A and a torsion spring 46B. An upper portion of the arm portion 46A is installed to the body frame 15 (side frame 15A on the left side), with a shaft portion 46C as a support such that the arm portion 46A is pivotably (rotatably) movable in the front-rear direction. Moreover, the arm portion 46A is biased toward the LED unit 40 all the time, by the torsion spring 46B. Accordingly, the arm portion 46A presses the LED unit 40 toward the second positioning member 120.

The second pressing member 46 is arranged at both left and right ends of the LED unit 40 (frame body 42A), and at a rear side of the LED unit 40. More elaborately, each of the second pressing members 46 at both left and right end portions has a pressing portion 46D which presses the LED unit 40, which is arranged to face the second positioning member 120 or the third positioning member 130, such that the LED unit 40 (supporting frame 42) is sandwiched between the pressing portion 46D and one of the second positioning member 120 and the third positioning member 130 (only one side of the second pressing member 46 is shown in FIG. 3).

According to the structure described above, the second positioning member 120 and the third positioning member 130 are in a contact with a front-side lower portion at both ends of the supporting frame 42, and the first positioning member 110 makes a contact with a rear-side upper portion at the left end of the supporting frame 42. Accordingly, the LED unit 40 is positioned in front-rear direction with respect to the photoconductive drum 53. Moreover, since the guide roller 43 makes a contact with the surface of the photoconductive drum 53, the LED unit 40 is positioned in vertical direction with respect to the photoconductive drum 53.

Next, an arrangement for stabilizing the position of the LED unit 40 with respect to the photoconductive drum 53 will be described below. In the following description, a point of action 45A means a point of action when the pressing spring 45 presses the LED unit 40 (a bottom surface of the recess 42C of the supporting frame 42) toward the photoconductive drum 53.

As shown in FIGS. 2 and 3, the point of action 45A of the pressing spring 45 is positioned at a side nearer to the photoconductive drum 53 (lower side of the first positioning member 110) than the first positioning member 110 in the vertical direction. To describe more elaborately, the point of action 45A is positioned between the first positioning member 110 (first positioning portion 112) and the second positioning member 120 (second positioning portion 122) in the vertical direction, and is positioned in a triangular-shaped area which is formed by the first positioning portion 112, the second positioning portion 122, and the third positioning portion 132 (refer to dot-dashed line), when viewed from the front-rear direction. In the description, the triangular-shaped area includes an area on the three sides of the triangle.

Figure 4A:
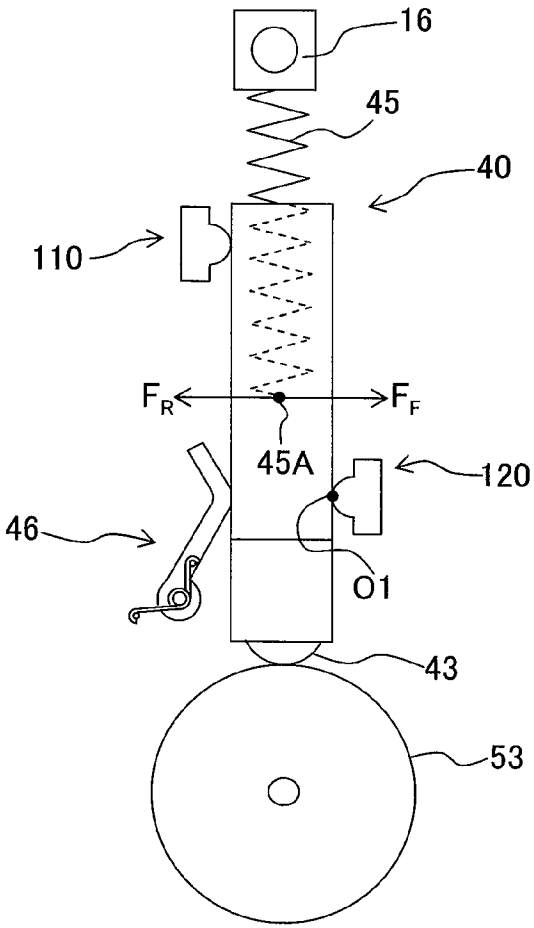
Figure 4B:
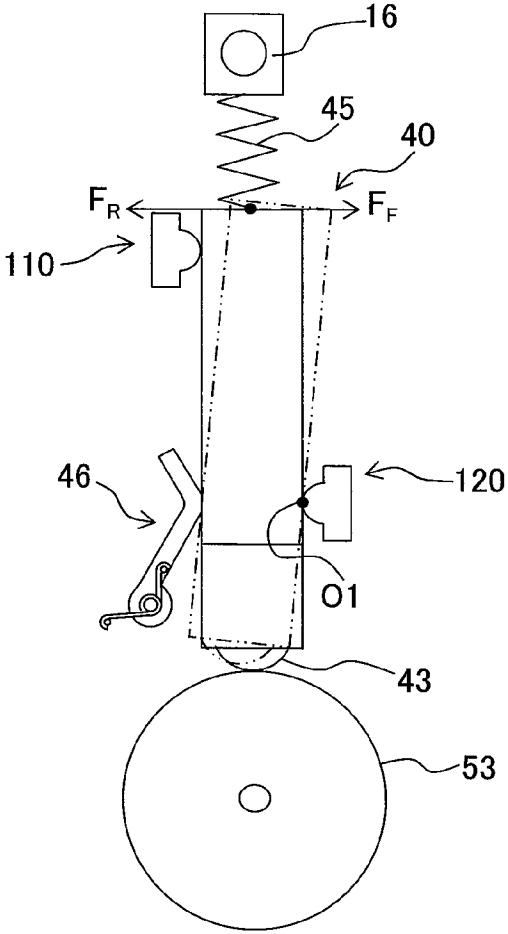
Figure 4C:
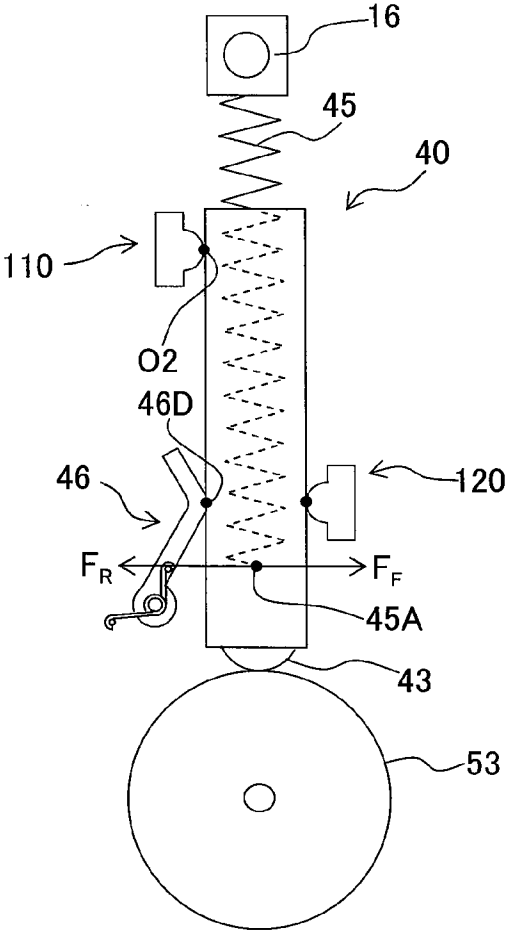

Here, an action (an effect) by the point of action 45A of the pressing spring 45 being at the abovementioned position will be described below. FIGS. 4A, 4B, and 4C are diagrams for explaining an action of the first embodiment. FIG. 4A shows a structure of the first embodiment in which a point of action of a pressing spring is positioned between a first positioning member and a second positioning member. FIG. 4B shows a structure of an example for comparison in which the point of action of the pressing spring is positioned at an upper side of the first positioning member. FIG. 4C shows a structure of a modified example when the point of action of the pressing spring is positioned at a lower side of the second positioning member. In FIG. 4A, for the convenience of description, the point of action 45A is shown to be near a center between the first positioning member 110 and the second positioning member 120.

In the structure of the first embodiment shown in FIG. 4A, minute vibrations are generated in the color printer 1. For instance, when the point of action 45A has shifted rearward, and a force $F_R$ drawing the LED unit 40 away from the second positioning member 120 is exerted, the LED unit 40 is supported by the first positioning member 110, and furthermore, the LED unit 40 is restricted (regulated) from being drawn away from the positioning member due to the thrust of the second pressing member 46. Accordingly, it is possible to stabilize the position of the LED unit 40 in the front-rear direction with respect to the photoconductive drum 53.

Moreover, a distance between a contact portion (supporting point O1) of the second positioning member 120 which is a pivot center, and the point of action 45A is short. Therefore, even when the point of action 45A has shifted frontward, and a force $F_F$ which draws the LED unit 40 away from the first positioning member 110 is exerted, for pivoting (rotating) the LED unit 40, a comparatively substantial force is necessary for wobbling (moving) the LED unit 40. Therefore, since the wobbling of the LED unit 40 is suppressed by a comparatively small force by the minute vibrations, it is possible to stabilize the position of the LED unit 40, in the front-rear direction with respect to the photoconductive drum 53.

In such manner, in the arrangement of the first embodiment, even when the point of action 45A has shifted either frontward or rearward, by suppressing the action of the LED unit 40 being drawn away from the positioning member (effect of vibrations), it is possible to stabilize the position of the LED unit 40, in the front-rear direction with respect to the photoconductive drum 53.

On the other hand, in the structure of the example for comparison shown in FIG. 4B, the LED unit 40 is supported by the first positioning member 110 and the second positioning member 120. Therefore, when the point of action 45A has shifted rearward, and the force $F_R$ is exerted, the position of the LED unit 40 in the front-rear direction is stabilized. However, since the distance between the point of action 45A and the supporting point O1 is long, when the point of action 45A has shifted frontward, and the force $F_F$ is exerted, the LED unit 40 is wobbled even by a comparatively small force due to the minute vibrations, and is drawn away from the first positioning member 110 (refer to dot-dashed line). It is not possible to control the direction of the shift of the point of action 45A due to the vibration (frontward or rearward). Therefore, when the LED unit 40 is drawn away from the positioning member by being shifted to one of the frontward and the rearward direction, it is not possible to stabilize the position of the LED unit 40 with respect to the photoconductive drum 53.

In the first embodiment, the structure may be such that the point of action 45A of the pressing spring 45 is positioned at the lower side of the second positioning member 120 (nearer to the photoconductive drum 53 than the second positioning member 120). In such structure, as shown in FIG. 4C, when the point of action 45A has shifted frontward and the force $F_F$ is exerted, the LED unit 40 is supported by the first positioning member 110 and the second positioning member 120. Therefore, it is possible to stabilize the front-rear direction of the LED unit 40 with respect to the photoconductive drum 53.

Moreover, a distance between the pressing portion 46D of the second pressing member 46 which is a pivot center, and the point of action 45A is short. Therefore, when the point of action 45A has shifted rearward, and the force $F_R$ is exerted, a comparatively substantial force is necessary for wobbling (moving) the LED unit 40. Therefore, since the wobbling of the LED unit 40 is suppressed by a comparatively small force by the minute vibrations, it is possible to stabilize the position of the LED unit 40, in the front-rear direction with respect to the photoconductive drum 53.

However, in this case, since the distance between the point of action 45A and a supporting point O2 is long, an effect that the first positioning member 110 supports the LED unit 40 cannot be expected. Consequently, according to the first embodiment, the structure in which the point of action 45A is positioned between the first positioning member 110 and the second positioning member 120 is capable of stabilizing to the maximum extent the position of the LED unit 40 with respect to the photoconductive drum 53.

According to the abovementioned description, it is possible to achieve the following effect in the first embodiment. The point of action 45A of the pressing spring 45 is positioned at a side nearer to the photoconductive drum 53 than the first positioning member 110 in the vertical direction. More elaborately, the point of action 45A is positioned between the first positioning member 110 and the second positioning member 120. Therefore, even when the point of action 45A has shifted to any of the frontward or the rearward direction due to the vibrations, by suppressing the action of the LED unit 40 being drawn away from the positioning member, it is possible to stabilize the position of the LED unit 40 with respect to the photoconductive drum 53. Accordingly, since it is possible to stabilize the position of the LED head 41 (LED array 41A) and the photoconductive drum 53, it is possible to suppress a degradation of an image quality in the color printer 1.

The first positioning member 110 is positioned at a rear-side upper portion of the LED unit 40, the second positioning member 120 is positioned at a front-side lower portion of the LED unit 40, and the pressing portion 46D of the second pressing member 46 is arranged to face the second positioning member 120, sandwiching the LED unit 40. Therefore, even when a force rotating in a counterclockwise direction (a torque in a counterclockwise direction) in FIG. 3 acts on the LED unit 40, it is possible to regulate (restrict) by the first positioning member 110 and the second positioning member 120. Accordingly, it is possible to stabilize the position of the LED unit 40 with respect to the photoconductive drum 53.

In the first embodiment, the pressing portion 46D of the second pressing member 46 has been arranged to face the second positioning member 120, sandwiching the LED unit 40. However, the present invention is not restricted to such an arrangement. For instance, a portion of the second pressing member 120 which presses the exposure unit may be arranged to be positioned at a side nearer to the photoconductive body than the second positioning member 120. Accordingly, since the second pressing member 120 applies the torque in the counterclockwise direction in FIG. 4 to the exposure unit (LED unit 40), the exposure unit is biased toward the first positioning member 110 and the second positioning member 120. Accordingly, it is possible to stabilize the position of the LED unit 40 with respect to the photoconductive drum 53.

Since the point of action 45A of the pressing spring 45 is positioned in the triangular-shaped area which is defined by the first positioning portion 112, the second positioning portion 122, and the third positioning portion 132 when viewed from the front-rear direction, it is possible to minimize a torque (a force of rotation) of the LED unit 40 with a side of the triangle as an axis of rotation.

The point of action 45A of the pressing spring 45 is on the supporting frame 42 (bottom surface of the recess 42C), and the first positioning member 110 and the second positioning member 120 make a contact with the supporting frame 42. Therefore, it is possible to prevent a force from being exerted to the LED head 41. Accordingly, since it is possible to prevent a deformation of the LED head 41 which is sought to be positioned highly accurately (precisely) with respect to the photoconductive drum 53, it is possible to maintain an accuracy of position (positioning) of the LED array 41A and the photoconductive drum 53, and to improve the image quality of the color printer 1.

In the first embodiment, the first positioning member 110 is arranged at the rear side (upstream side in the movement direction) of the LED unit 40, and the second positioning member 120 is arranged at the front side (downstream side in the movement direction) of the LED unit 40. However, the present invention is not restricted to such arrangement. In other words, the first positioning member may be arranged at the downstream side in the movement direction, and the second positioning member may be arranged at the upstream side in the movement direction.

Second Embodiment

Figure 5:
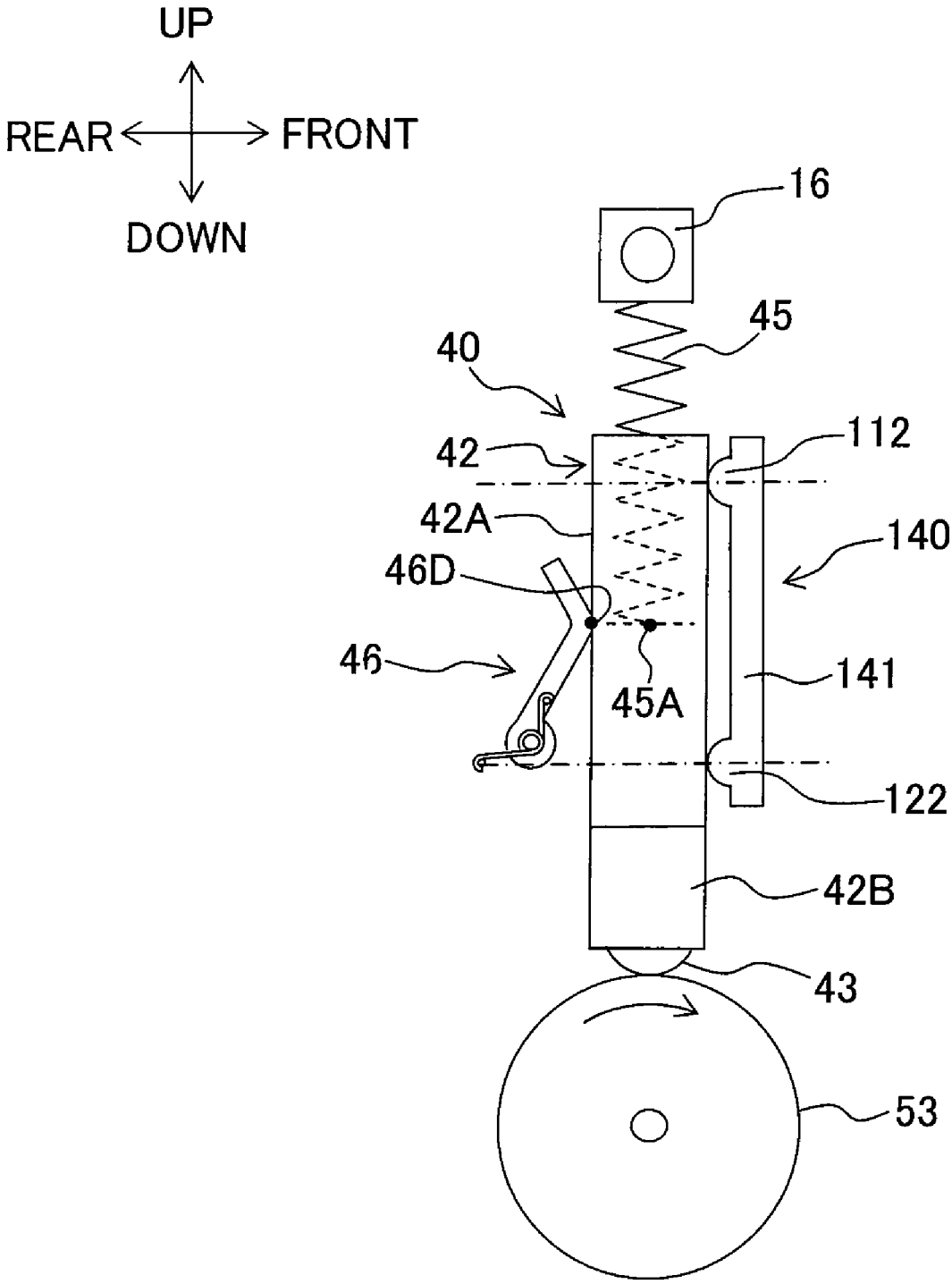
FIG. 5 is a diagram when a mechanism of an LED unit and other units around the LED unit according to a second embodiment is viewed from a left side.
Figure 6:
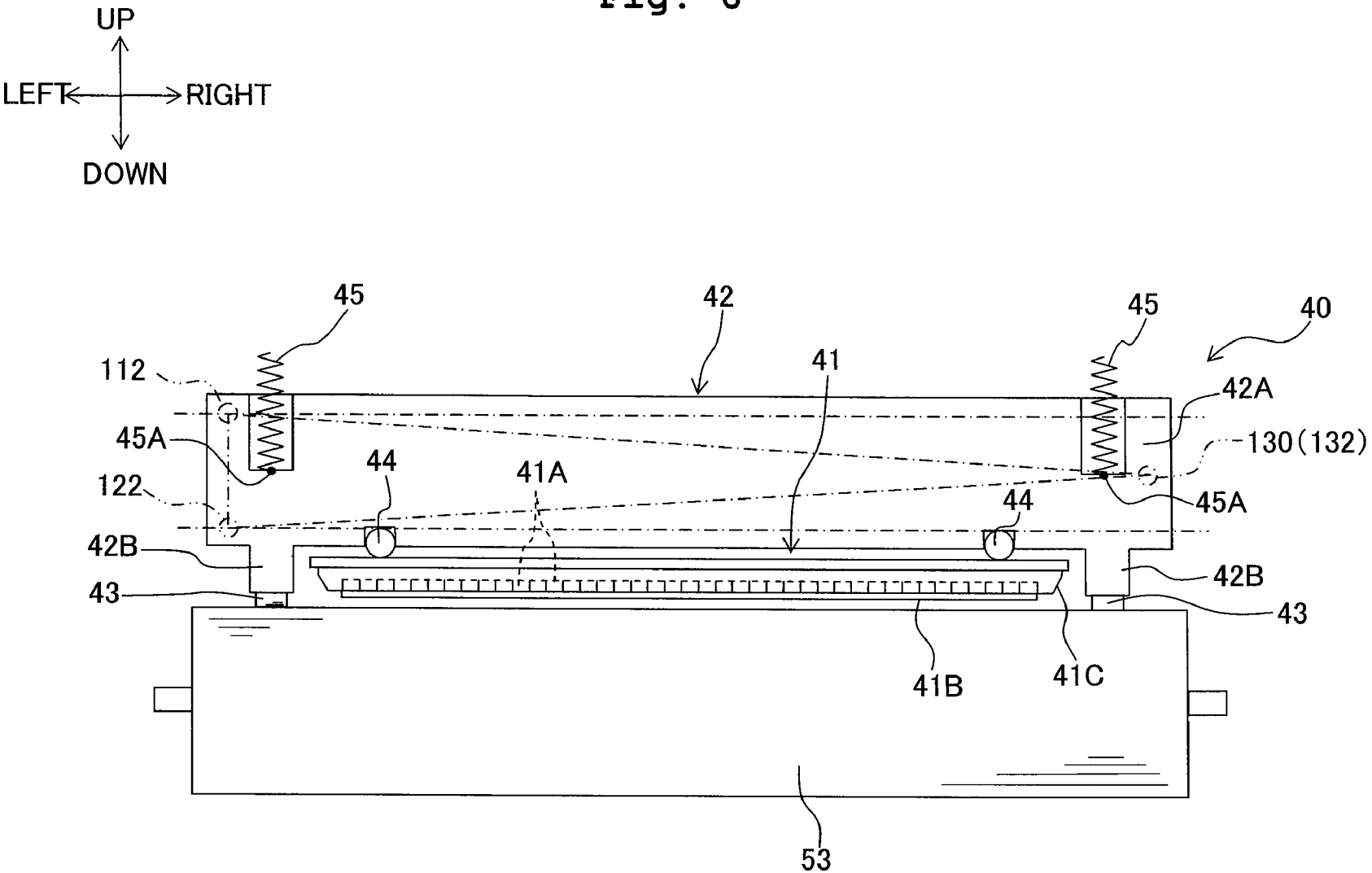
FIG. 6 is a diagram when the mechanism of the LED unit and other units around the LED unit according to the second embodiment is viewed from a front side.

Next, a second embodiment of the present invention will be described below in detail with reference to the accompanying diagrams. FIG. 5 is a diagram showing a left-side view of a mechanism including an LED unit and other units around the LED unit according to the second embodiment, and FIG. 6 is a diagram showing a front-side view of the mechanism including the LED unit and other units around the LED unit according to the second embodiment. In the second embodiment, mainly, a position of a point of action of the mechanism around the LED unit is different from the position in the first embodiment. Therefore, the point of difference will be described below in detail. Same reference numerals are assigned to structural components which are similar as in the first embodiment, and description of such components is omitted.

In the second embodiment, the LED unit 40 is positioned with respect to the photoconductive drum 53 by a positioning member 140, the third positioning member 130, and the second pressing member 46 provided to the body frame 15.

As shown in FIGS. 5 and 6, the positioning member 140 is arranged at a left-end side (left-edge side) of the LED unit 40, and at the front side of the LED unit 40. In other words, the positioning member 140 is arranged at one-end in the longitudinal direction of the frame body 42A, at the downstream side in the movement direction with respect to the LED unit 40. The positioning member 140 includes a plate-shaped base portion 141 which is longer in a vertical direction and which is fixed to the body frame 15 (inner surface of the side frame 15A on the left side), a first positioning portion 112 which protrudes in the form of a substantially semispherical protrusion from a rear-surface upper portion of the base portion 141, and a second positioning portion 122 which protrudes in the form of a substantially semispherical protrusion from a rear-surface lower portion of the base portion 141.

The third positioning member 130 is arranged at a right-end side (the other end side in the longitudinal direction) of the LED unit 40 (frame body 42A), in the left-right direction. The third positioning member 130, similarly as the positioning member 140, is arranged at the front side of the LED unit 40 in the front-rear direction, and is arranged at a substantial center between the first positioning portion 112 and the second positioning portion 122, in the vertical direction. The third positioning member 130 includes a plate-shaped base portion (not shown in the diagram) which is fixed to the body frame 15 (inner surface of the side frame 15A on the right side), and a third positioning portion 132 which protrudes in the form of a substantially semispherical protrusion from a rear surface of the base portion.

In the second embodiment, the second pressing member 46 is arranged at the both left and right end sides of the LED unit 40, and at the rear side of the LED unit 40. More elaborately, the second pressing member 46 at a left-end side has the pressing portion 46D which presses the LED unit 40, which is arranged to be positioned at a substantially central position between the first positioning portion 112 and the second positioning portion 122 in the vertical direction, and which is arranged to face the positioning member 140 sandwiching the LED unit 40. Moreover, although it is not shown in the diagram, the second pressing member 46 at the left-end side is arranged such that the pressing portion 46D which presses the LED unit 40 is arranged to face the third positioning member 130 sandwiching the LED unit 40.

In this manner, in the LED unit 40 of the second embodiment, the first positioning portion 112 and the second positioning portion 122 of the positioning member 140 make a contact with an upper site and a lower site of the supporting frame 42 at the left-end portion (left-edge portion) thereof, respectively, and the third positioning member 132 makes a contact with a central portion on a rear side at the left end (left edge) of the supporting frame 42. Accordingly, the LED unit 40 is positioned in the front-rear direction with respect to the photoconductive drum 53.

In the second embodiment, the point of action 45A of the pressing spring 45 is positioned at a substantially central position between the first positioning portion 112 and the second positioning portion 122 in the vertical direction. To describe further, the point of action 45A, as shown in FIG. 6, is positioned in a triangular-shaped area (refer to dot-dashed line) (including a linear area on the three sides of the triangle) defined by the first positioning portion 112, the second positioning portion 122, and the third positioning portion 132 when viewed from the front-rear direction.

Figures 7A, 7B, 7C:
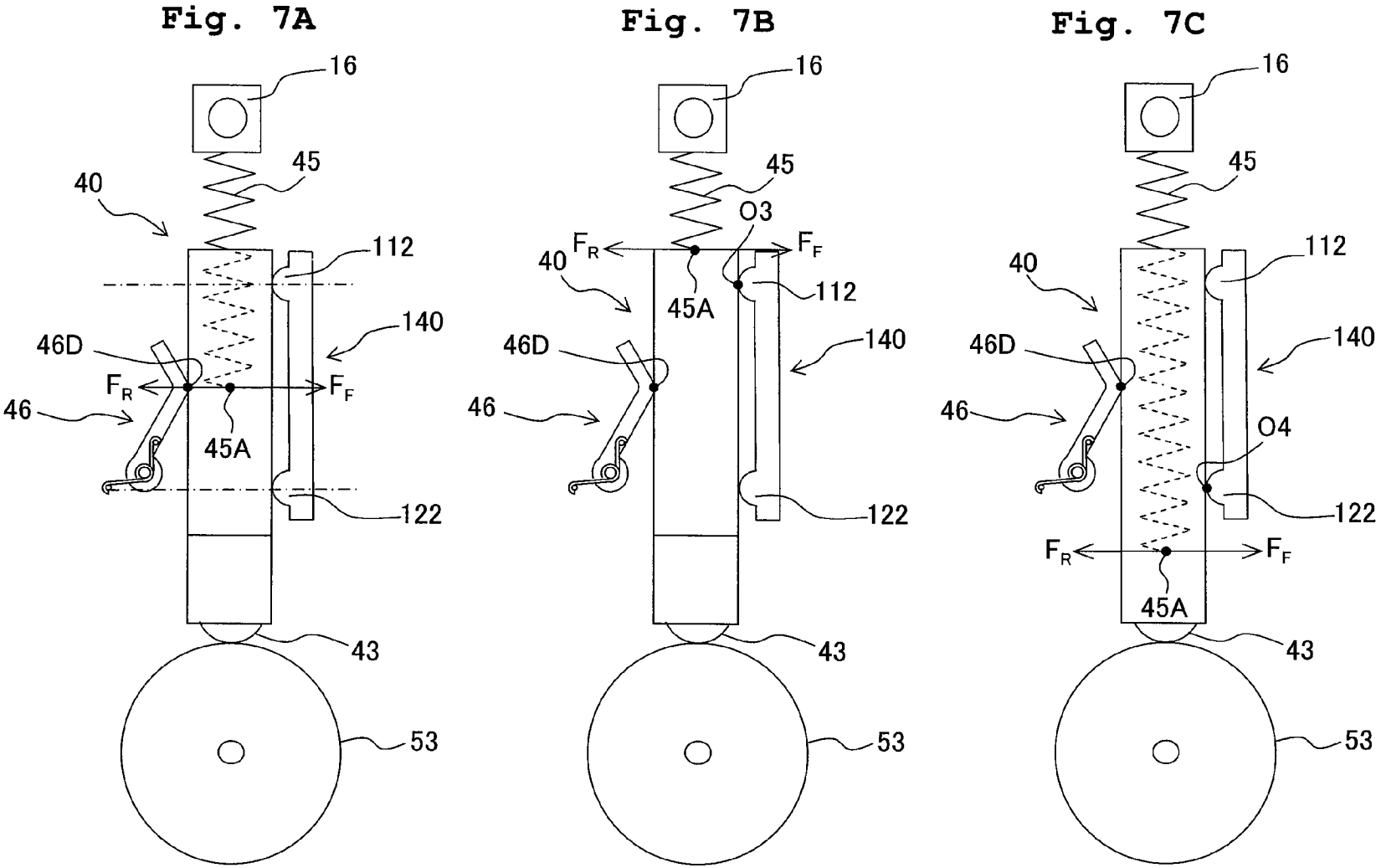

Here, in the second embodiment, an effect by the point of action 45A of the pressing spring 45 being at the abovementioned position, will be described below. FIGS. 7A, 7B, and 7C are diagrams for explaining an action of the second embodiment. FIG. 7A shows an example in which a point of action of a pressing spring is positioned between a first positioning member and a second positioning member. FIG. 7B shows a first example for comparison in which the point of action of the pressing spring is positioned at an upper side of the first positioning member. FIG. 7C shows a second example for comparison in which the point of action of the pressing spring is positioned at a lower side of the second positioning member.

In the structure of the second embodiment shown in FIG. 7A, when minute vibrations are generated, and the force $F_F$ is exerted by shifting forward of the point of action 45A, the LED unit 40 is supported by the first positioning portion 112 and the second positioning portion 122. Moreover, when the point of action 45A has shifted rearward, and the force $F_R$ is exerted, the LED unit 40 is restricted (regulated) from being drawn away from the positioning portion (positioning member) due to the thrust of the second pressing member 46. Accordingly, it is possible to stabilize the position of the LED unit 40 in the front-rear direction with respect to the photoconductive drum 53.

In this manner, in the structure of the second embodiment, even when the point of action 45*a* has shifted either frontward or rearward, by suppressing the action of the LED unit 40 being drawn away from the positioning member (effect of vibrations), it is possible to stabilize the position of the LED unit 40, in the front-rear direction with respect to the photoconductive drum 53.

On the other hand, when the point of action 45A is positioned at the upper side of the first positioning portion 112 as in the first example for comparison shown in FIG. 7B, and when the point of action 45A is positioned at the lower side of the second positioning member 122 as in the second example for comparison shown in FIG. 7C, it is impossible to stabilize the position of the LED unit 40 with respect to the photoconductive drum 53.

In other words, in FIGS. 7B and 7C, when the point of action has shifted frontward, and the force $F_F$ is exerted, a distance between the point of action 45A and a supporting point O3 (or a supporting point O4) which becomes a pivot center is short. Therefore, the LED unit 40 is hardly wobbled even by a comparatively small force due to the minute vibrations. However, when the pressing member 46D is positioned toward the first positioning portion 112 in FIG. 7B or when the pressing member 46D is positioned toward the second positioning portion 122 in FIG. 7C, according to a principle of leverage, it is possible to oscillate (wobble) the second pressing member 46 by a smaller force than in a case of pressing the pressing portion 46D directly. Consequently, the position of the LED unit 40 may become unstable compared to the position in the structure of the second embodiment.

Moreover, when the point of action 45A has shifted rearward, and the force $F_R$ is exerted, a distance between the point of action 45A and the pressing portion 46D of the second pressing member 46 which is a pivot center becomes long. Therefore, the LED unit 40 wobbles even by a comparatively small force due to the minute vibrations, and is drawn away from the first positioning portion 112 (or the second positioning portion 122), thereby the position of the LED unit 40 becoming unstable. Accordingly, in the structure of the first example for comparison and the second example for comparison, it is not possible to stabilize the position of the LED unit 40 with respect to the photoconductive drum 53.

According to the abovementioned description, it is possible to achieve the following effect in the second embodiment. Since the first positioning portion 112 and the second positioning portion 122 are arranged at the front side of the LED unit 40, and the pressing portion 46D of the second pressing member 46 is arranged between the first positioning portion 112 and the second positioning portion 122 in the vertical direction, it is possible to stabilize the position of the LED unit 40 with respect to the photoconductive drum 53 by suppressing the action of the LED unit 40 of being drawn away from the positioning member. Accordingly, it is possible to suppress the degradation of the image quality in the color printer 1.

Since the point of action 45A of the pressing spring 45 is positioned in the triangular-shaped area which is defined by the first positioning portion 112, the second positioning portion 122, and the third positioning portion 132 when viewed from the front-rear direction, it is possible to minimize a torque (a force of rotation) of the LED unit 40 with a side of the triangle as an axis of rotation.

In the second embodiment, the positioning member 140 (the first positioning portion 112 and the second positioning portion 122) has been arranged at the front side (downstream side in the movement direction) of the LED unit 40. However, the present invention is not restricted to such arrangement. In other words, the first positioning member and the second positioning member may be arranged at the upstream side in the movement direction.

Moreover, in the second embodiment, the positioning member 140 (the first positioning portion 112 and the second positioning portion 122) has been arranged at a left-end side of the LED unit 40. However, the present invention is not restricted to such arrangement. In other words, the first positioning member and the second positioning member may be arranged at a right-end side of the LED unit 40.

Third Embodiment

Figure 8:
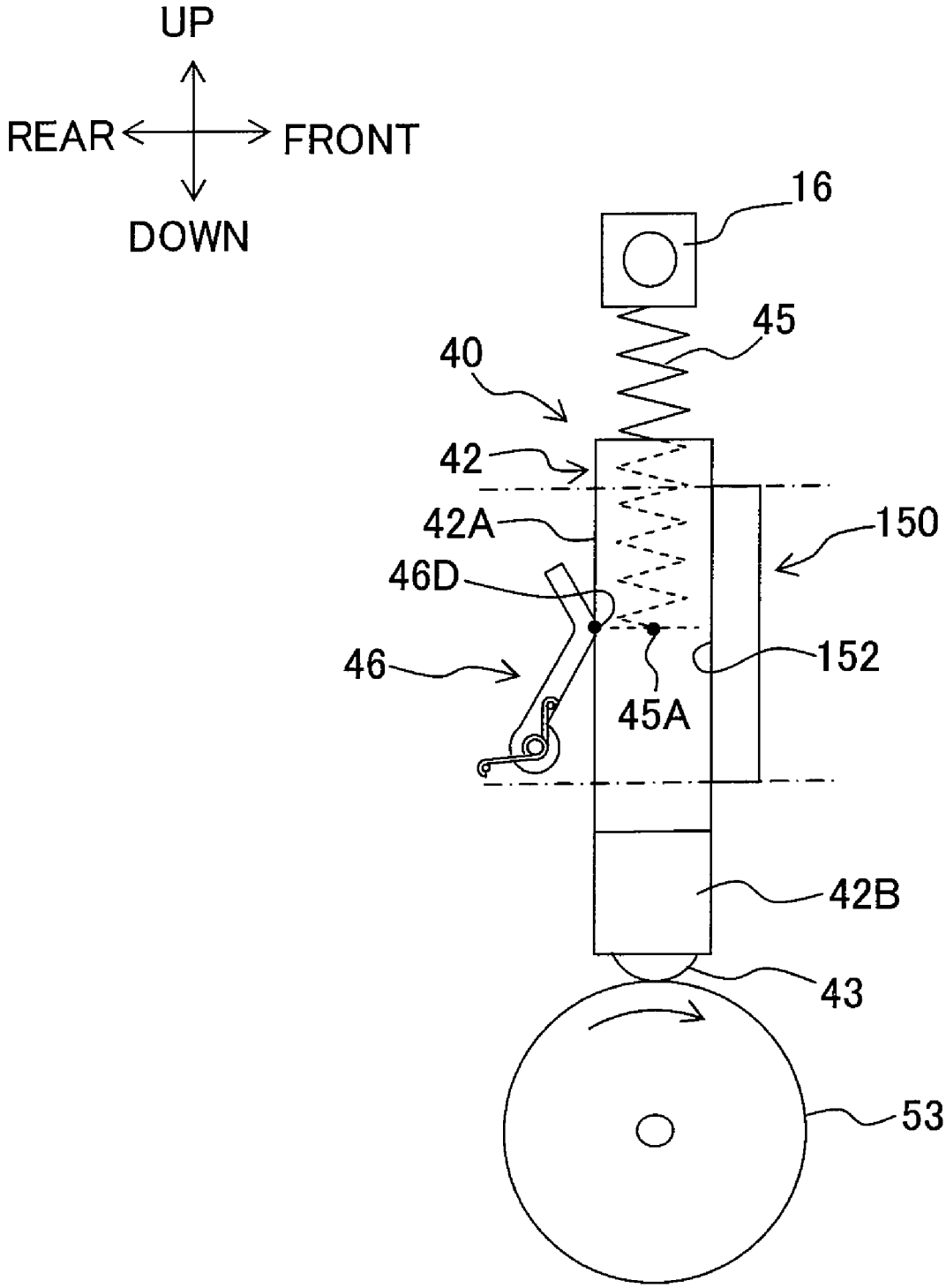
FIG. 8 is a diagram when a mechanism of an LED unit and other units around the LED unit according to a third embodiment is viewed from a left side.

Next, a third embodiment of the present invention will be described below in detail with reference to the accompanying diagrams. FIG. 8 is a diagram showing a left side view of a mechanism including an LED unit and other units around the LED unit according to the third embodiment. Since the third embodiment differs from the second embodiment at a point that, a fourth positioning member 150 is used instead of the positioning member 140, the point of difference will be described below. Same reference numerals are assigned to structural components which are similar as in the second embodiment, and description of such components is omitted.

As shown in FIG. 8, the fourth positioning member 150 is formed to be a long plate having a predetermined length in the vertical direction, and is fixed to the body frame 15 (inner surface of the side frame 15A on the left side). A rear surface (positioning surface) 152 of the fourth positioning member 150 makes a surface-contact with the LED unit 40 (supporting frame 42), and positions the LED unit 40 in the front-rear direction.

In the third embodiment, the second pressing member 46 at the left-end side (left-edge side) is arranged to face the fourth positioning member 150 sandwiching the LED unit 40, and presses the LED unit 40 toward the fourth positioning member 150. More elaborately, the second pressing portion at the left-end side is positioned at a substantial center between an upper end and a lower end of the fourth positioning member 150.

In the third embodiment, the point of action 45A of the pressing spring 45 is positioned at a substantial center in a range of an outer frame in an area of surface contact between the LED unit 40 (supporting frame 42) and the fourth positioning member 150 when viewed from the front-rear direction.

Accordingly, in the third embodiment, it is possible to achieve an effect same as in the second embodiment. Moreover, since the fourth positioning member 150 and the LED unit 40 make a surface-contact, it is possible to support the LED unit 40 more stably.

Fourth Embodiment

Figure 10:
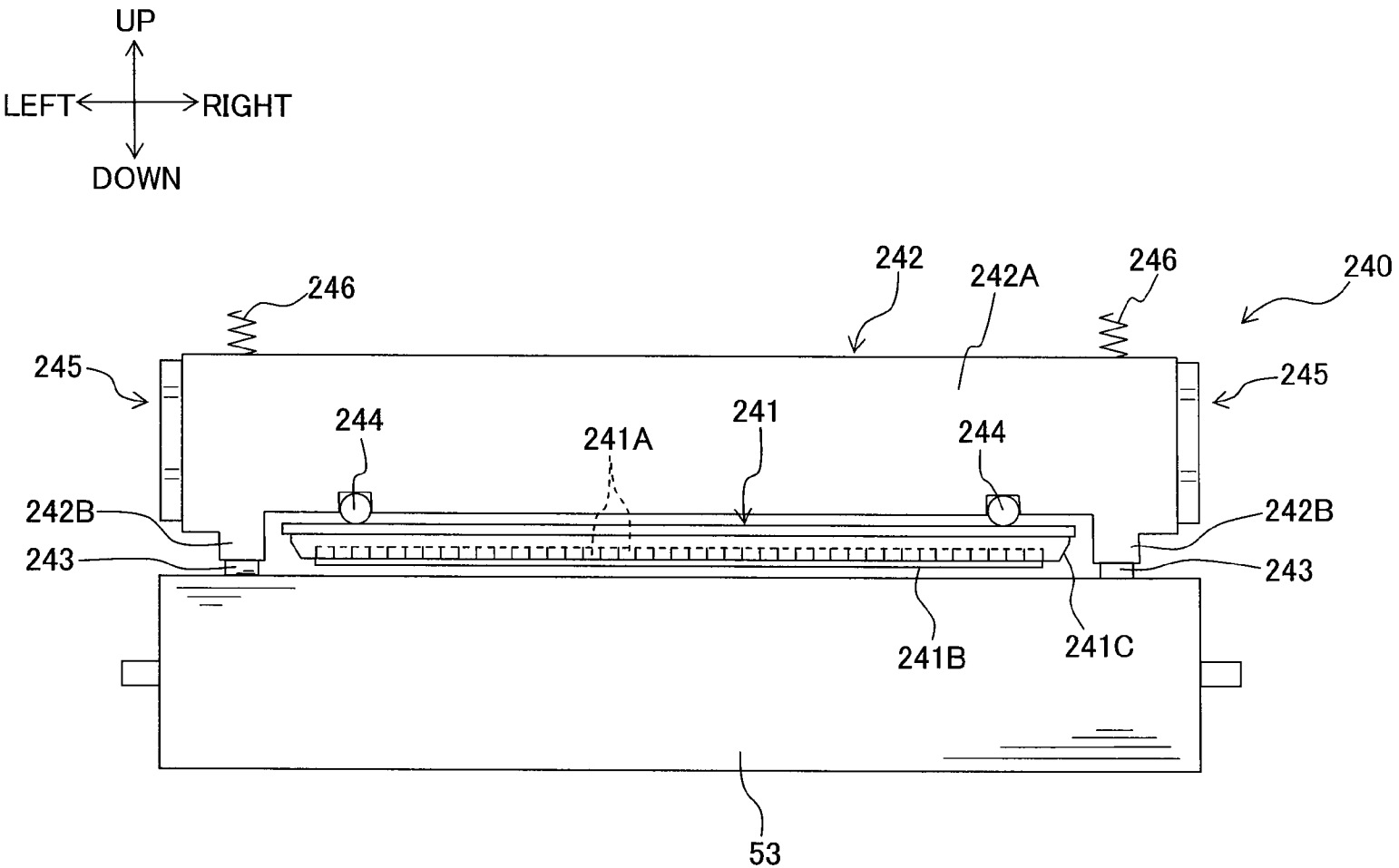
FIG. 10 is a diagram when the LED unit is viewed from a front side.
Figure 11:
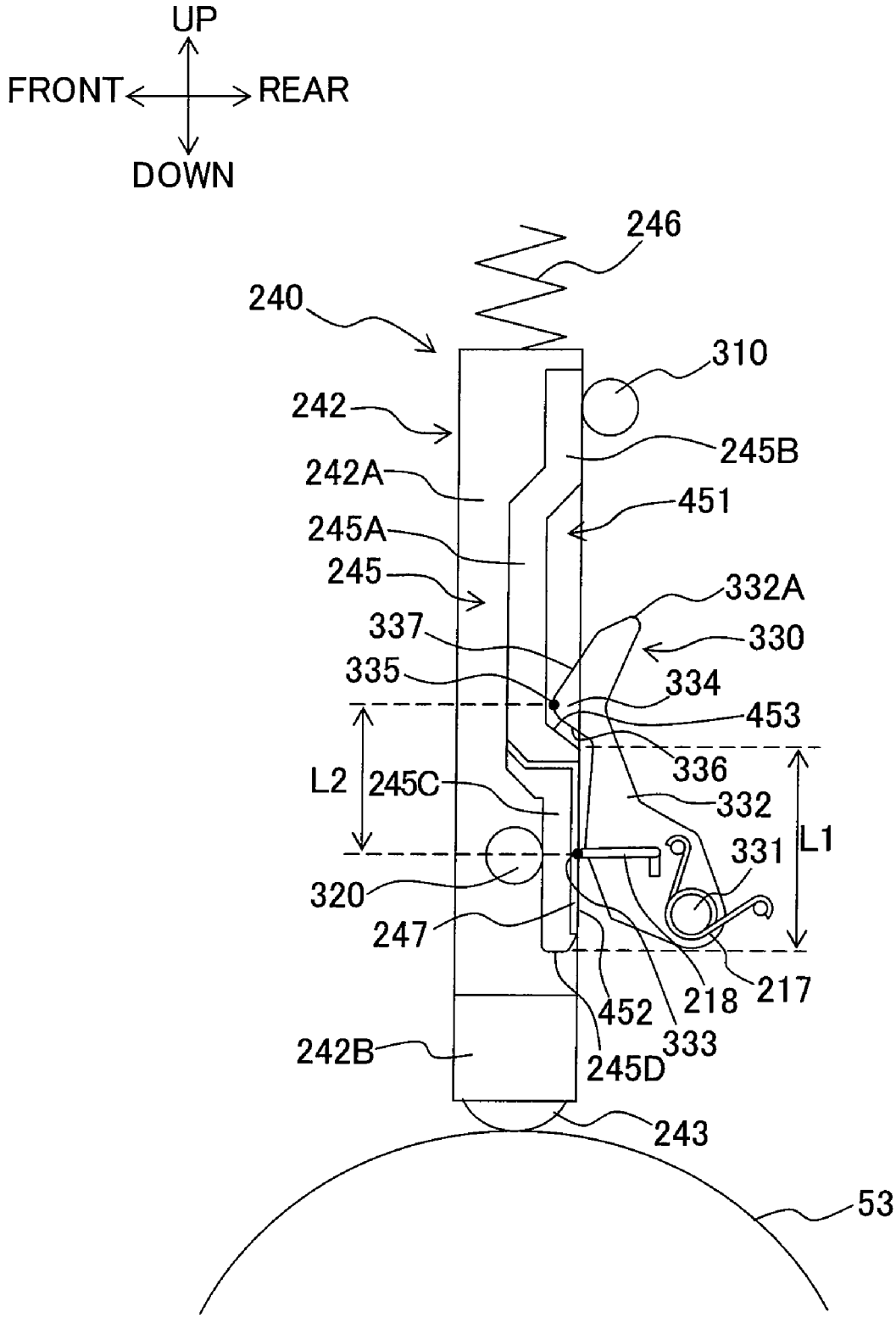
FIG. 11 is a diagram when the LED unit and a turnable arm are viewed from a side.

Next, a mechanism including an LED unit 240 and other units around (front side of) the LED unit 240 which is a salient feature of an image forming apparatus (a color printer 201, refer to FIG. 9) according to a fourth embodiment will be described below in detail. FIG. 10 is a diagram showing a front side view of the LED unit, and FIG. 11 is a diagram showing a side view of the LED unit and a turnable arm. Regarding the structure which has already been described in the embodiments from the first embodiment to the third embodiment, same reference numerals are assigned to components which are similar, and the description of such components is omitted.

Here, in the following description, directions are assigned based on the LED unit 240 at the exposing position in FIG. 9. Moreover, in the following description, a 'movement direction' is a direction of the LED unit 240 approaching (moving closer to) or separating away from the photoconductive drum 53, and in the fourth embodiment, the 'movement direction' coincides substantially with the vertical direction. Moreover, a 'bias direction' is direction in which a turnable arm 330 which will be described later applies a bias to the LED unit 240, and in the fourth embodiment, the bias direction coincides substantially with the frontward direction. Furthermore, a 'longitudinal direction' is a longitudinal direction of the LED unit 240, and in the fourth embodiment, the longitudinal direction coincides substantially with the left-right direction (axial direction of the photoconductive drum 53).

As shown in FIG. 10, the LED unit 240 includes mainly, the LED head 41 (exposing member), a supporting frame 242, two guide rollers 43, two eccentric cams 44, and two guiding portions 245. The LED head 241, the guide roller 43, and the eccentric cam 44 are similar as those already described. Therefore, the description thereof is omitted.

Figure 9:
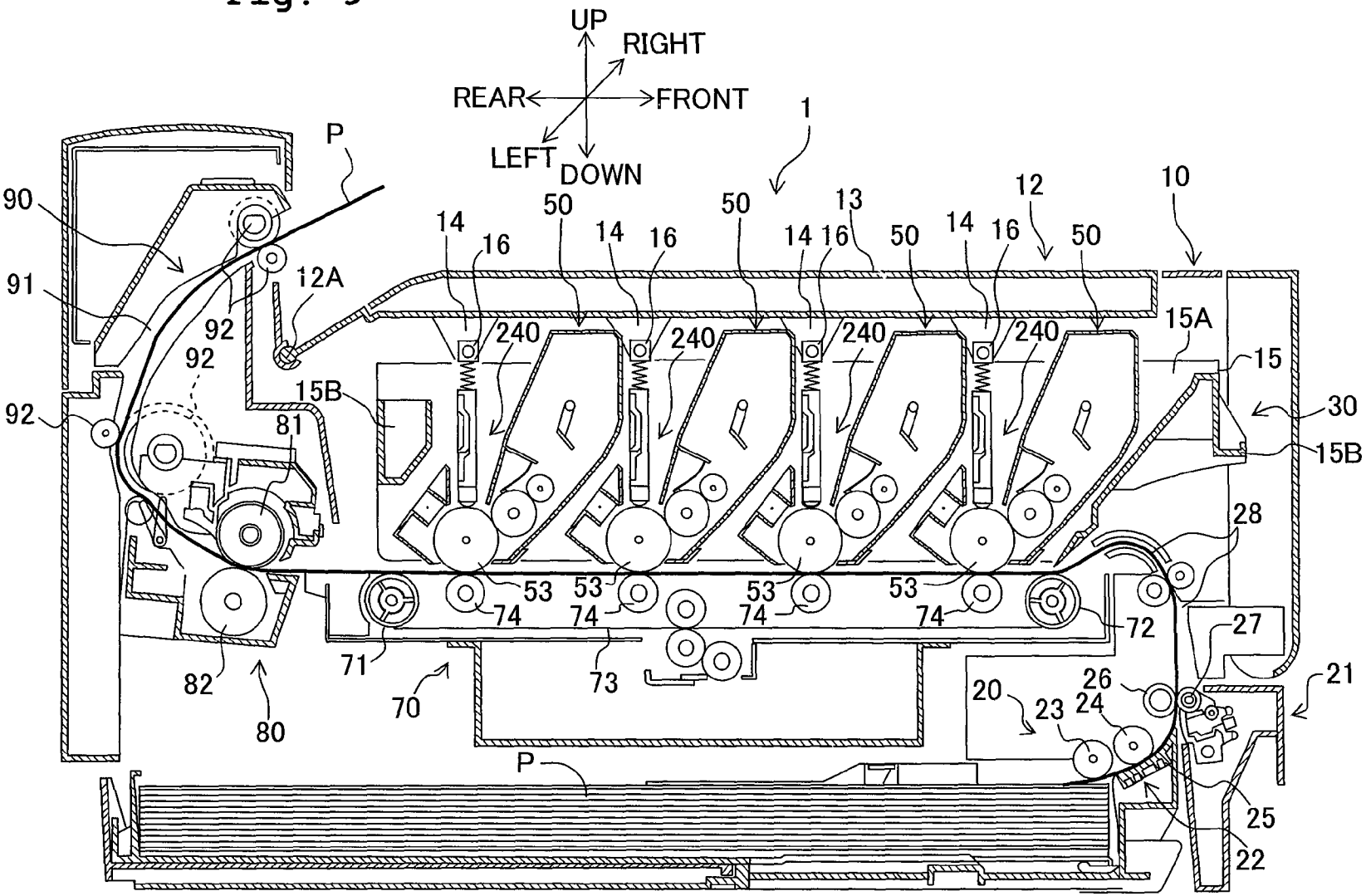
FIG. 9 is a cross-sectional view showing an overall structure of a color printer as an example of an image forming apparatus according to a fourth embodiment.

The supporting frame 242 is a member made of a resin (material) which supports the LED head 41 from an upper side, and is installed on the LED installing portion 14 via the holder 16 (refer to FIG. 9). The supporting frame 242 includes mainly, a frame body 242A, and a roller supporting portion 242B which is extended downward from both left and right end sides of the frame body 242A. Here, the description of details of a structure of the holder 16 supporting the supporting frame 242 is omitted.

A pressing spring 246 (compression coil spring) is installed at a position directly above each roller supporting portion 242B, on an upper surface of the frame body 242A. An upper end of the pressing spring 246 is attached to (engaged with) the holder 16, and a lower end of the pressing spring 246 is attached to the frame main-body 242A. Therefore, when the pressing spring 246 is compressed by being pressed, the supporting frame 242 (the LED unit 240) is pressed toward the photoconductive drum 53.

The guide roller 43 is rotatably supported at a lower end of the roller supporting portion 242B. As it has been described above, the guide roller 43 is a distance-maintaining member which maintains a spacing distance between the LED head 41 and the photoconductive drum 53 to be constant, and makes a contact with the surface of the photoconductive drum 53 when the LED unit 240 is at the exposing position. When the guide roller 43 makes a contact with the surface of the photoconductive drum 53, the LED unit 240 is positioned in a vertical direction with respect to the photoconductive drum 53.

When the thrust from the pressing spring 246 is transmitted to the guide roller 43 via the supporting frame 242, the guide roller 43 is pressed against the photoconductive drum 53, and is driven and rotated with respect to the photoconductive drum 53. The guide roller 43 may make a contact with a photosensitive layer (a layer on which an electrostatic latent image is formed by being exposed) of the surface of the photoconductive drum 53, or may make a contact with an area on an outer side than the photosensitive layer in the left-right direction (area with no photosensitive layer), of the surface of the photoconductive drum 53.

The guiding portion 245 protrudes toward an outer side from both sides (both side surfaces) in the longitudinal direction of the supporting frame 242 (frame body 242A). The guiding portion 245, as shown in FIG. 11, is extended in the movement direction (vertical direction), and a central base portion 245A at a substantial center is bent toward frontward direction. Accordingly, an accommodating portion 451 in the form of a recess is formed between an upper base portion 245 and a lower base portion 245C. The accommodating portion 451 accommodates (receives) a protruding-contact portion (a door-opening contact portion) of the turnable arm 330, without making a contact, when the LED unit 240 is at the exposing position (state shown in FIG. 11).

A rear surface of the lower base portion 245C is facing the turnable arm 330 when the LED unit 240 is at the exposing position. In this manner, the rear surface of the lower base portion 245C is a sliding-contact surface 452 which makes a sliding contact with a protruding-contact portion 334 of the turnable arm 330 when the LED unit 240 is installed. The sliding-contact surface 452 is formed by a metallic plate 247 as an example of an electroconductive member. More elaborately, the metallic plate 247 which becomes an earth terminal of the LED unit 240 (LED head 241) is installed on the rear surface of the lower base portion 245C, and forms the sliding-contact surface 452. Description of details of a concrete structure connecting electrically the LED head 241 and the metallic plate 247 is omitted.

In the fourth embodiment, the guiding portion 245 has three wall surfaces (a rear surface of the central base portion 245A, a lower surface of the upper base portion 245B, and an upper surface of the lower base portion 245C) facing the accommodating portion 451. A third inclined surface 453 which is inclined downward from a front side to a rear side in FIG. 11, in the vertical direction, is formed on an upper surface of the lower base portion 245C positioned at a lower side (toward the exposing position in the movement direction), out of the three wall surfaces.

When the LED unit 240 formed as described above is at the exposing position, a rear surface of the upper base portion 245B makes a contact with a first positioning member 310, and the lower base portion 245C is held (pinched) by a second positioning member 320 and the turnable arm 330. Accordingly, the LED unit 240 is positioned in the front-rear direction with respect to the photoconductive drum 53. A structure of each component and a positional relationship of each component with the LED unit 240 will be described below.

The first positioning member 310, the second positioning member 320, and the turnable arm 330 are provided to a body frame (each side frame 215A) which is arranged on both sides in the longitudinal direction of the LED unit 240 at the exposing position. In the following description, only a structure on the right side of the LED unit 240 will be explained. The left and right sides of the LED unit 240 are symmetrical, and the left side has a similar structure as the right side.

The first positioning member 310 is formed to be circular cylindrical shaped, and is arranged face-to-face with the rear surface of the upper base portion 245B of the guiding portion 245, at a rear side of the upper portion of the LED unit 240. The first positioning member 310 makes a contact with the rear surface of the upper base portion 245B, and restricts (regulates) the LED unit 240 from wobbling rearward (oscillating rearward) with the second positioning member 320 as a center.

The second positioning member 320 is formed to be circular cylindrical shaped, and is arranged face-to-face with the front surface of the lower base portion 245C of the guiding portion 245. The second positioning member 320 makes a contact with the front surface of the lower base portion 245C, and the lower base portion 245C (guiding portion 245) is held (pinched) between the second positioning member 320 and the turnable arm 330. Accordingly, the LED unit 240 is positioned in the front-rear direction.

The turnable arm 330 is arranged face-to-face with the rear surface of the lower base portion 245C of the guiding portion 245. The turnable arm 330 includes mainly, a shaft portion 331, an arm portion 332, a contact portion 333, and the protruding-contact portion 334. The turnable arm 330 is supported by the body frame 215 such that a front-end portion 332A is pivotable frontward and rearward, with the shaft portion 331 as a supporting point.

The arm portion 332 is extended substantially directly above (toward a drawn-away position in the movement direction) with respect to the shaft portion 331. A front-end portion 332A of the arm portion 332 (turnable arm 330) is biased toward a direction (frontward direction) of approaching toward (a direction closer to) the LED unit 240 all the time, by a torsion spring 217 (a bias applying member). The contact portion 333 is provided at a portion of the arm portion 332, facing the second positioning member 320.

The contact portion 333 makes a contact with the sliding-contact portion 452 of the guiding portion when the LED unit 240 is at the exposing position, and protrudes from the arm portion 332 toward the direction of the bias (frontward direction). The contact portion 333 is formed by a metal wire 18 as an example of an electroconductive member, and a part of the contact portion 333 is attached to (installed on) the arm portion 332 to protrude frontward from the arm portion 332. The metal wire 18 is electrically ground via the body frame 215. Details of a concrete structure connecting electrically the metal wire 18 to the ground is omitted.

The protruding-contact portion 334 is provided at the front-end portion 332A side of the contact portion 333 of the arm portion 332, in other words, at a position farther than the contact portion 333, from the shaft portion 331, to protrude forward from the contact portion 333. The protruding-contact portion 334 forms a triangular shape (is substantially mountain shaped) in a side view, and has a sliding-contact portion 335 which makes a sliding contact with the sliding-contact surface 452 (guiding portion 245) when the LED unit 240 is installed.

A second inclined surface 336 which is extended downward from the sliding-contact portion 335, and which is inclined from a front side toward a rear side in FIG. 3, with respect to the vertical direction is formed on the protruding-contact portion 334. The second inclined surface 336 is facing the third inclined surface 453 of the guiding portion 245 when the LED unit 240 is at the exposing position.

The turnable arm 330 has a first inclined surface 337 which is inclined upward from the sliding-contact portion 335 toward the front-end portion 332 of the arm portion 332 through an upper portion of the protruding-contact portion 334. The first inclined surface 337 makes a sliding contact with a front-end portion 245D of the guiding portion 245 when the LED unit 240 is installed.

In the fourth embodiment, a length L1 in a vertical direction of the sliding-contact surface 452 of the guiding portion 245 is longer (more) than a length L2 from the sliding-contact portion 335 up to the contact portion 333 in the direction in which the turnable arm 330 (arm portion 332) is extended.

Figure 12A:
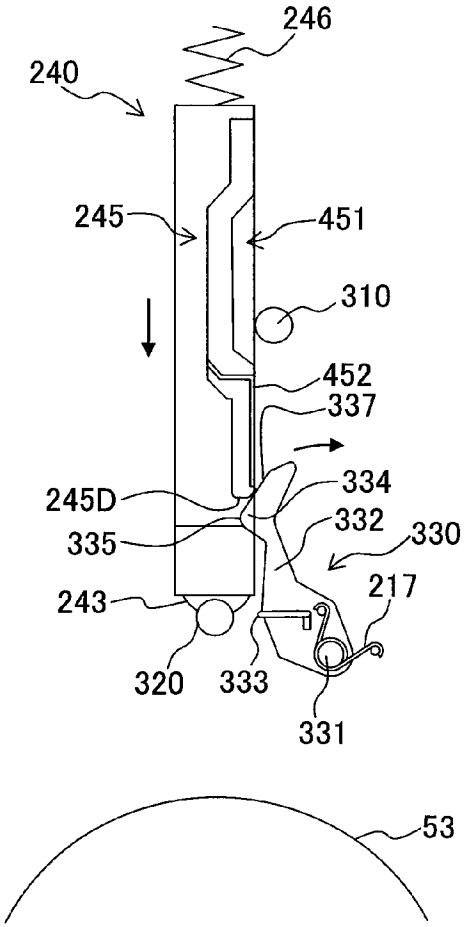
Figure 12B:
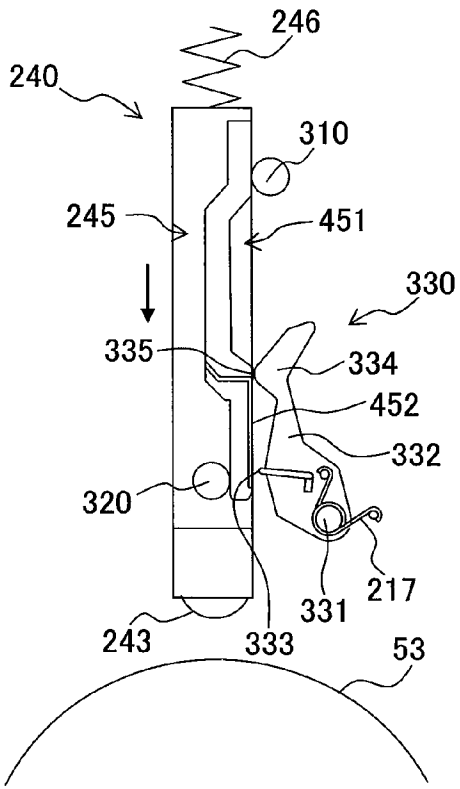
Figure 12C:
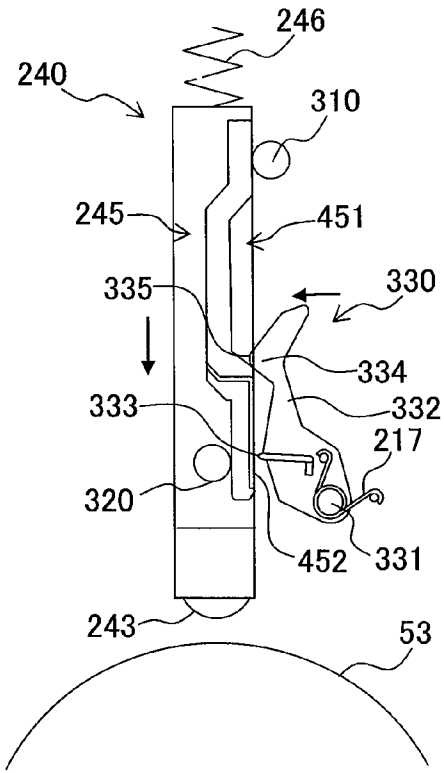

In the color printer 201 structured as described above, an action and effect of the turnable arm 330 at the time of moving the LED unit 240 from the drawn-away position to the exposing position (when the LED unit 240 is mounted) will be described. FIGS. 12A, 12B, and 12C are diagrams for explaining an action of the turnable arm at the time of mounting the LED unit. FIG. 12A shows as to how the turnable arm is moved (pivoted) in a direction of separating away from the LED unit, while a guiding portion making a contact with a protruding-contact portion, FIG. 12B shows as to how the guiding portion makes a sliding contact with the protruding-contact portion, and FIG. 12C shows as to how the turnable arm is moved (pivoted) in a direction of approaching the LED unit.

As shown in FIG. 12A, as the LED unit 240 is lowered toward the exposing position by closing the top cover 12, the front-end portion 245D (a lower end of the lower base portion 245) which is a front side in the movement direction of the guiding portion 245, makes a contact with an upper portion (first inclined surface 337) of the protruding-contact portion 334. Thereafter, when the LED unit 240 is pressed down further, by the front-end portion 245D making a sliding contact with (on) the first inclined surface 337, the turnable arm 330 is pivoted (moves) in a direction of separating away (rearward direction) from the LED unit 240.

The protruding-contact portion 334 is at a position farther than the contact portion 333, from the shaft portion 131, for instance, as compared to a structure of pivoting (moving) the turnable arm 330 by the front-end portion 245D making a sliding contact with the contact portion 333. Therefore, it is possible to pivot the turnable arm by a small force. Accordingly, a resistance of a bias of the torsion spring 217 which acts on the LED unit 240 (the guiding portion 245) from the turnable arm 330 (the protruding-contact portion 334) also becomes small.

When the LED unit 240 is pressed down further, the guiding portion 245 (the sliding-contact surface 452) goes on moving toward the exposing position (moving downward)

while making a sliding contact with the protruding-contact portion 334 (the sliding-contact portion 335) as shown in FIG. 12B. Since the protruding-contact portion 334 (the sliding contact portion 335) protrudes frontward than the contact portion 333, while the guiding portion 245 and the protruding-contact portion 334 make a sliding contact, the contact portion 333 and the guiding portion 245 are in a separated state (in a draw-apart state). Accordingly, since no force acts from the contact portion 333 to the guiding portion 245, it is possible to move the LED unit 240 (the guiding portion 245) toward the exposing position without being subjected to (without receiving) a substantial force (resistance).

Thereafter, as shown in FIG. 12C, when the sliding-contact portion 335 has passed the sliding-contact surface 452 and reaches an upper end (the third inclined surface 453) of the sliding-contact surface 452, the turnable arm 330 goes on moving in a direction of approaching (frontward direction) the LED unit 240 by the bias of the torsion spring 217. Moreover, as shown in FIG. 11, when the accommodating portion 451 has accommodated the protruding-contact portion 334, in other words, when the LED unit 240 has reached the exposing position upon the guide roller 43 making a contact with the surface of the photoconductive drum 53, the contact portion 333 makes a contact with the guiding portion 245 (the sliding-contact surface 452), and the guiding portion 245 is biased toward the second positioning member 320.

Since the contact portion 333 is at a position near the shaft portion 331, the guiding portion 245 is biased toward the second positioning member 320 by a force stronger than a force pivoting the turnable arm 330 rearward when the LED unit 240 is installed. Therefore, the contact portion 333 and the second positioning member 320 are capable of pinching the guiding portion 245 by a sufficient force. As it has been described above, the position in the front-rear direction of the LED unit 240 with respect to the photoconductive drum 52 is determined.

In this manner, according to the fourth embodiment, it is possible to reduce the resistance due to the force exerted to the LED unit 240 (the guiding portion 245) from the turnable arm 330 at the time of moving the LED unit 240 to the exposing position. Accordingly, since the LED unit 240 does not come to rest before reaching the exposing position, due to the resistance by the bias of the turnable arm 330, it is possible to move assuredly the LED unit 240 up to the exposing position. Consequently, it is possible to determine accurately, the position of the LED unit 240 with respect to the photoconductive drum 53, and as a result, it is possible to improve the image quality in the color printer 201.

Particularly, in the fourth embodiment, the length L1 in the movement direction of the sliding-contact surface 452 is longer than the length L2 from the sliding-contact portion 335 up to the contact portion 333 in the direction in which the arm portion 332 is extended. Therefore, when the sliding-contact portion 335 is at the upper end of the sliding-contact surface 452, a lower end of the sliding-contact surface 452 has passed the contact portion 333 (refer to FIG. 12B). Consequently, since a state in which there is no obstacle (resistance) for the downward movement of the guiding portion 245 is assumed, it is possible to move the LED unit 240 to the exposing position by applying a small force (such as a thrust of the pressing spring 246) to the LED unit 240.

Incidentally, when the length L1 is smaller than the length L2, even when the sliding-contact portion 335 reaches the upper end of the sliding-contact surface 452, the lower end of the sliding-contact surface 452 is still at an upper side (still above) the contact surface 333. For moving the LED unit 240 to the exposing position from this state, it is necessary to press the guiding portion 245 (the lower end or the front-end portion 245D of the sliding-contact surface 245) to the upper portion of the contact portion 333 by applying a comparatively substantial (stronger) force to the LED unit 240. Further, it is necessary to move the lower end of the sliding-contact surface 452 lower (downward) than the contact portion 333 while pivoting the turnable arm 330 resisting the bias of the torsion spring 217.

There is no problem when a force is applied to the LED unit 240 by pressing the top cover 12 further in. However, when the top cover 12 is closed completely in a state of the lower end of the sliding-contact surface 452 on the upper side of the contact portion 333, a force is to be applied to the LED unit 240 by the thrust of the pressing spring 246. In this case, when the thrust of the pressing spring 246 is weaker than the bias of the torsion spring 217, the LED unit 240 cannot be moved up to the exposing position.

Moreover, in the fourth embodiment, the sliding-contact surface 452 is formed by the metallic plate 247, and the contact portion 33 is formed by the metal wire 218. Therefore, the metallic plate 247 and the metal wire 218 are connected electrically by the sliding-contact surface 452 making a contact with the contact portion 333. Since the metal wire 218 is grounded electrically via the body frame 215, the LED unit 240 is also grounded via the metallic plate 247.

Consequently, since it is not necessary to provide separately a mechanism for grounding the LED unit 240, it is possible to simplify a mechanism of the LED unit 240 and an area around the LED unit 240, and to facilitate a cost reduction. Moreover, since it is possible to omit (save) a space for providing an independent mechanism for grounding the LED unit 240 electrically, it is possible to facilitate small-sizing (size reduction) of the color printer 201.

At the time of moving the LED unit 240 from the exposing position to the separating-away position, the top cover 12 is opened by turning (opening) upward. In the fourth embodiment, the turnable arm 330 has the second inclined surface 336 which is inclined downward from the sliding-contact portion 335, and the upper surface of the lower base portion 245C of the guiding portion 245 has the third inclined surface 453 which is inclined with respect to the movement direction. Therefore, it is possible to move the guiding portion 245 (the LED unit 240) smoothly while pivoting the turnable arm 330 rearward. Even in this case, since the resistance due to the force acting on the LED unit 240 (the guiding portion 245) from the turnable arm 330 is low, it is possible to move the LED unit 240 to the drawn-away position favorably.

Fifth Embodiment

Figure 13:
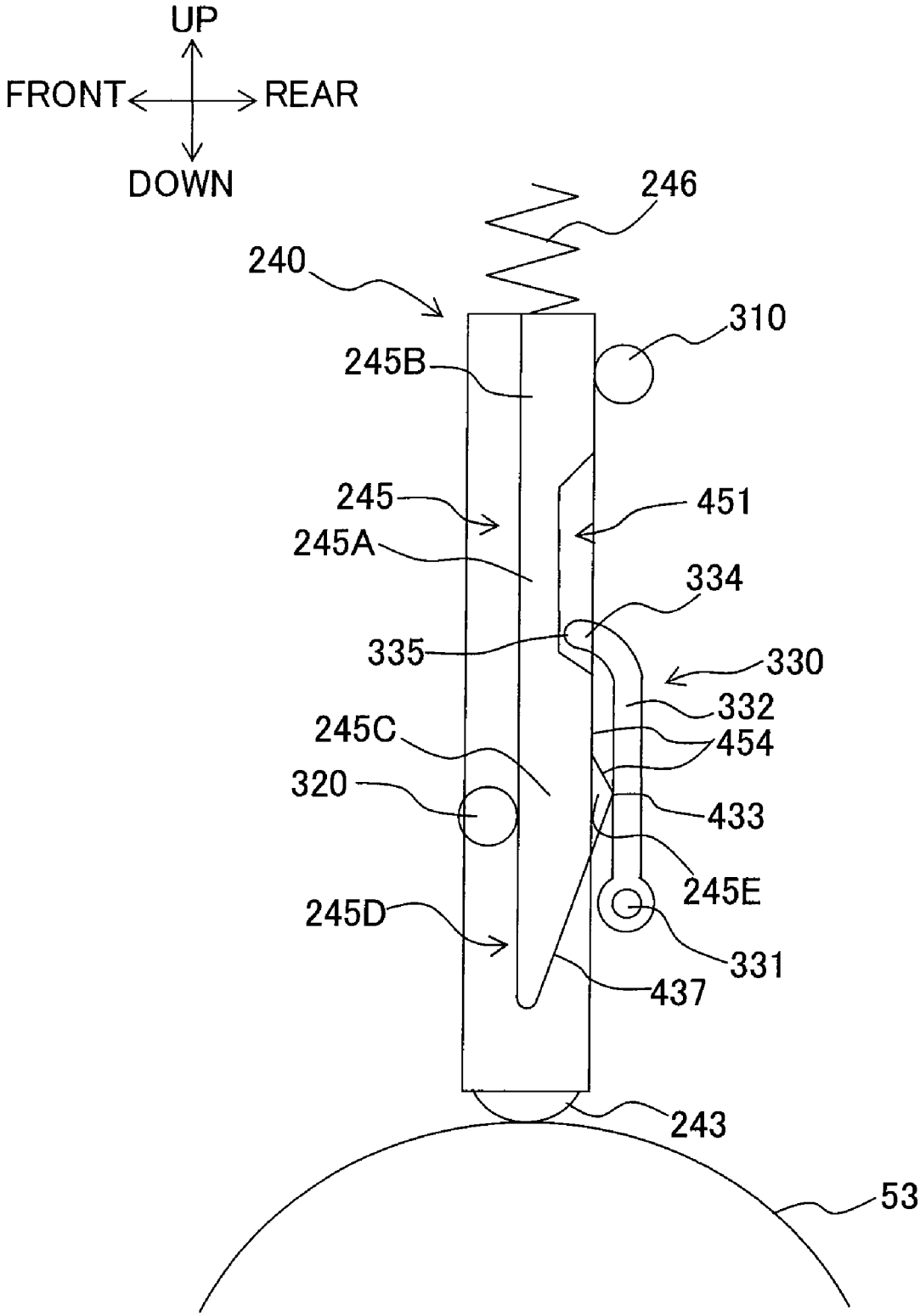
FIG. 13 is a diagram when an LED unit and a turnable arm of a fifth embodiment are viewed from a side.
Figure 14B:
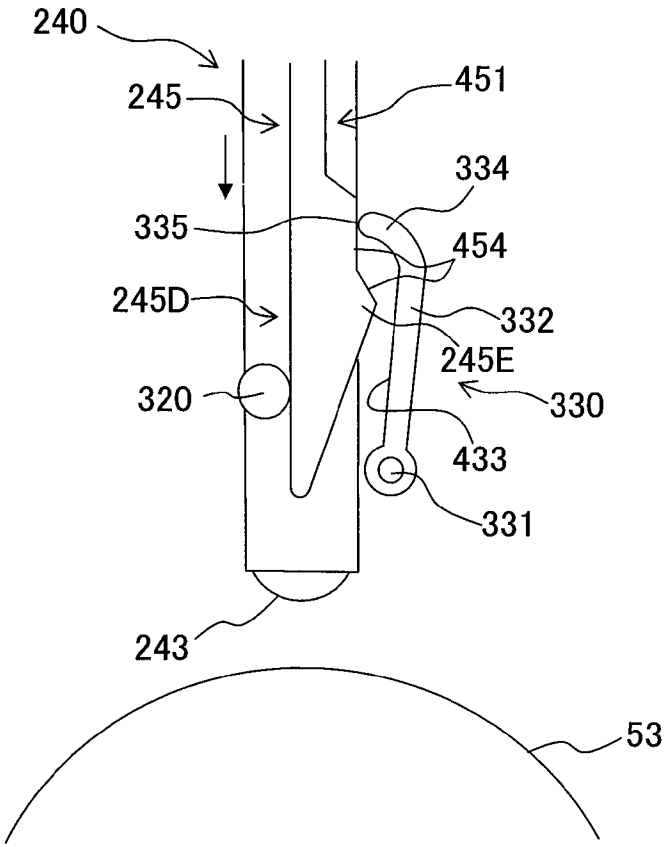
Figure 14A:
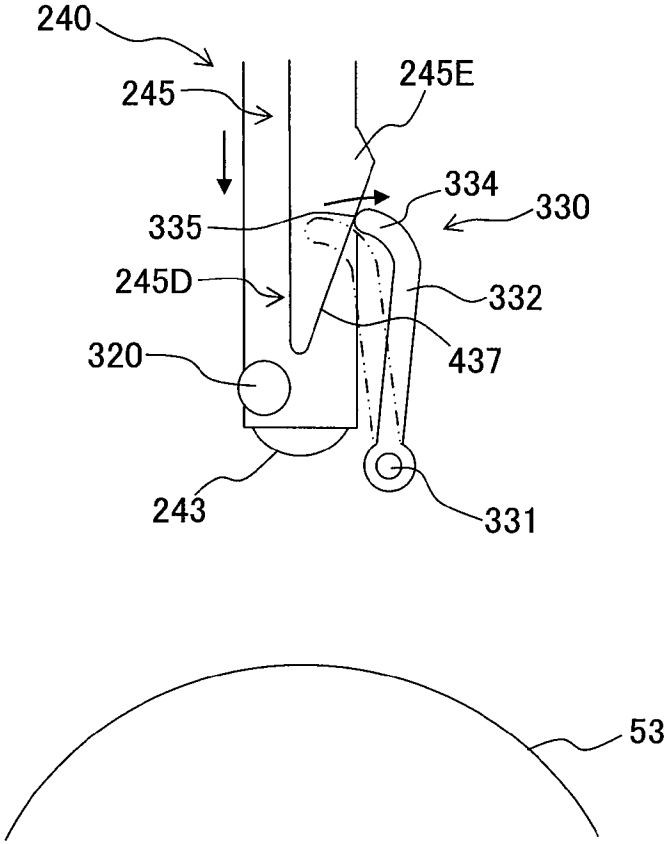

Next, a fifth embodiment of the present invention will be described below in detail with reference to the accompanying diagrams. FIG. 13 is a diagram showing a side view of an LED unit and a turnable arm of the fifth embodiment, and FIGS. 14A and 14B are diagrams for explaining an action of the turnable arm at the time of mounting the LED unit. FIG. 14A shows as to how the turnable arm is moved in a direction of separating away from the LED unit, while a guiding portion making a contact with a protruding-contact portion, and FIG. 14B shows as to how the guiding portion makes a sliding contact with the protruding-contact portion. Components having a similar function as in the embodiments from the first embodiment to the fourth embodiment are assigned same reference numerals, even though the shape of the components is different, and the description of such components is omitted.

In the fourth embodiment, the protruding-contact portion 334 has the first inclined surface 337. However, in the fifth embodiment, the front-end portion 245D of the guiding portion 245 has a first inclined surface 437 as shown in FIG. 13. The first inclined surface 437 is inclined from the front end (front tip) of the front-end portion toward an apex portion (reference numeral omitted) of a protrusion (projection) 245E having a substantially mountain shape, provided on the rear surface of the lower base portion 245C. Moreover, in the fifth embodiment, a portion from the apex portion of the protrusion 245E up to a rear-surface upper end of the lower base portion 245C is a sliding-contact surface 454.

Moreover, in the first embodiment described above, the structure in which the contact portion 333 protrudes in the bias direction (frontward direction) of the contact portion 333 has been shown. However, in the fifth embodiment, a dimension in the front-rear direction from a front surface of the arm portion 332 up to the sliding-contact portion 335 is larger than a dimension (height) in the frontward direction of the protrusion 245E.

Next, an effect at the time of mounting the LED unit 240 in the fifth embodiment will be described below in brief. As shown in FIG. 12A, as the LED unit 240 is lowered toward the exposing position by closing the top cover 12, the front-end portion 245D (the first inclined surface 437) makes a contact with the protruding-contact portion 334. Thereafter, when the LED unit 240 is pressed down further, by the protruding-contact portion 334 making a sliding contact on the first inclined surface 437, the turnable arm 330 is pivoted (moves) rearward.

When the LED unit 240 is pressed down further, the guiding portion 245 (the sliding-contact surface 454) goes on moving downward while making a sliding contact with the protruding-contact portion 334 (the sliding-contact portion 335) having surpassed (surpassing) the apex portion of the protrusion 245E as shown in FIG. 14B. A dimension in the front-rear direction of the protruding-contact portion 334, from the front surface of the arm portion 332 up to the sliding-contact surface 335 is larger than a height of the protrusion 245E. Therefore, while the guiding portion 245 and the protruding-contact portion 334 are making a contact, the contact portion 433 and the guiding portion 245 (the apex portion of the protrusion 245) are in a state of being separated.

Thereafter, as shown in FIG. 13, when the accommodating portion 451 has accommodated (received) the protruding-contact portion 334, in other words, when the LED unit 240 has reached the exposing position, the contact portion 433 makes a contact with the guiding portion 245 (the apex portion of the protrusion 245E), and the guiding portion 245 is biased toward the second positioning member 320 (a member applying a bias to the turnable arm 330 is omitted in FIG. 13). Even with the color printer according to the fifth embodiment, it is possible to achieve an effect similar to that of the fourth embodiment.

The embodiments of the present invention have been described above. However, the present invention is not restricted to the embodiments described above, and regarding a concrete structure, various modifications which fairly fall within the basic teaching herein set forth are possible.

The positioning members such as the first positioning member 110, the second positioning member 120, the third positioning member 130, the positioning member 140, and the fourth positioning member 150 shown in the embodiments from the first embodiment to the third embodiments are mere examples of the positioning members, and the present invention is not restricted to these positioning members. In other words, it is possible to modify the positioning members to any positioning members which fairly fall within the basic teachings herein set forth, provided that the positioning members show the same effect as the first positioning member 110, the second positioning member 120, the third positioning member 130, the positioning member 140, and the fourth positioning member 150.

In the embodiments from the first embodiment to the third embodiment, an example in which the pressing spring 45 (compression coil spring) as a first pressing member is used has been shown. However, the present invention is not restricted to the compression coil spring, and a spring such as a torque spring and a plate spring, and a material or a member other than spring, having a predetermined elasticity (resilience) may be used.

In the embodiments from the first embodiment to the third embodiment, the second pressing member 46 has been arranged to face the positioning member, sandwiching the LED unit 40. However, the present invention is not restricted to such an arrangement, and in the first embodiment, only one second positioning member may be arranged at a substantial center between the second positioning member 120 and the third positioning member 130 when viewed from the front-rear direction. Moreover, in the second embodiment, only one second positioning member may be provided at a substantial center of a perpendicular which is extended from the third positioning portion 332 up to a side connecting the first positioning portion 112 and the second positioning portion 122, when viewed from the front-rear direction.

The second pressing member "presses the exposure unit toward the second positioning member" means that the second pressing member presses the exposure unit toward at least the second positioning member, and doesn't mean to exclude an arrangement in which the exposure unit is pressed also to the first positioning member and the third positioning member by the second pressing member. Moreover, three or more second pressing members may be provided to one exposure unit.

The structure of the second pressing member 46 shown in the embodiments from the first embodiment to the third embodiment is an example, and the present invention is not restricted to this structure. In other words, it is possible to modify the second pressing member to any pressing member which fairly falls within the basic teachings herein set forth, provided that the modified pressing member shows the same effect as the second pressing member 46. For instance, a spring such as a coil spring or a plate spring, or a material or a member other than spring, having a predetermined elasticity (resilience) may be used as the second pressing member.

The structure and the shape of the guiding portion 45 and the turnable arm 130 shown in the embodiments from the first embodiment to the third embodiment are examples, and the present invention is not restricted to these structure and shape. In other words, it is possible to modify the guiding portion and the turnable arm to any structure and shape which fairly fall within the basic teachings herein set forth, provided that the modified structure and shape show the same effect as the guiding portion 45 and the turnable arm 130. For instance, the shaft portion of the turnable arm is not restricted to a shaft which is provided to protrude from the turnable arm, and may be a recess or a hole which supports a shaft provided to the body frame.

In the fourth embodiment and the fifth embodiment, one of the protruding-contact portion 334 and the front-end portion 245D of the guiding portion 245 has the first inclined surface 337 and the first inclined surface 437. However, the present invention is not restricted to such an arrangement. In other words, both the protruding-contact portion and the front-end portion of the guiding portion may have the first inclined surface.

In the fourth embodiment and the fifth embodiment, the guiding portion 245 protrudes from both sides in the longitudinal direction of the supporting frame 242 toward an outer side. However, the present invention is not restricted to such an arrangement, and for instance, both sides (two sides) (both side portions) in the longitudinal direction of the exposure unit (the supporting frame) may be the guiding portion. Moreover, in the fourth embodiment and the fifth embodiment, the shape of the two guiding portions 245 is same (bilaterally symmetrical). However, the present invention is not restricted to the guiding portions of the same shape, and for instance, the guiding portions on two sides (in the longitudinal direction of the exposure unit) may have different shapes.

In the fourth embodiment and the fifth embodiment, the contact portion 33 protrudes toward the bias direction, and the contact portion 433 has a flat shape. However, the present invention is not restricted to such an arrangement, and for instance, the contact portion may be a bottom surface of a recess which is provided in the arm portion.

In the fourth embodiment and the fifth embodiment, the turnable arm 330 is biased by using the torsion spring 217. However, the present invention is not restricted to such an arrangement, and for instance, the turnable arm may be biased by a spring such as a coil spring, a tension spring, a plate spring, or an elastic material other than spring.

In the fourth embodiment and the fifth embodiment, the accommodating portion 451 has a shape of a recess formed in the guiding portion. However, the accommodating portion of the present invention is not restricted to such shape, and for instance, a notch may be formed in the guiding portion, or a space may be formed at an upper side of the guiding portion.

In the fourth embodiment and the fifth embodiment, the length L1 in the longitudinal direction of the sliding-contact surface 452 is more than the length L2 from the sliding-contact portion 335 up to the contact portion 333 in the direction in which the arm portion 332 is extended. However, the present invention is not restricted to such an arrangement. For instance, it is only necessary that the lower end of the sliding-contact surface has passed the contact portion, during the period after the protruding-contact portion (sliding-contact portion) has reached the upper end of the sliding-contact surface (refer to FIG. 12B) and before the protruding-contact portion has accommodated completely by the accommodating portion, In this case, the length L1 and the length L2 may be the same, or the length L2 may be longer than the length L1.

The color printer according to the fourth embodiment and the fifth embodiment has both the second inclined surface 336 and the third inclined surface 453. However, the present invention is not restricted to such an arrangement, and for instance, the color printer may have one of the second inclined surface and the third inclined surface, or may not have any of the second inclined surface and the third inclined surface.

In the fourth embodiment and the fifth embodiment, the metal wire 218 and the metallic plate 247 are used as an example of an electroconductive member. However, the electroconductive material of the present invention is not restricted to the metal wire and the metallic plate, and a wide range of materials or members may be used provided that the material or the member is electroconductive. For example, the turnable arm and the guiding portion may be let to be made of a metal. It is adequate that the electroconductive material is provided to a portion at which the contact portion and the guiding portion make a mutual contact when the exposure unit is at the exposing position. Moreover, a structure (a mechanism) for grounding the exposure unit electrically may be provided separately apart from the portion at which the contact portion and the guiding portion make a mutual contact.

In the fourth embodiment and the fifth embodiment, the body frame 215 was provided separately from the body 10. However, the present invention is not restricted to such an arrangement. In other words, the body frame of the present invention may be a body of the apparatus main-body for example, or may be a pair of metallic panels arranged at both sides in the longitudinal direction of the exposure unit, inside the body of the apparatus body.

In the embodiments described above, the LED array 41A in which a plurality of LEDs are lined up in a row has been used as an example of a blinking portion. However, the present invention is not restricted to such an arrangement, and for instance, an EL (electro-luminescent) element or a fluorescent substance may be used. Moreover, there may be one light emitting element for forming the blinking portion. For example, one back light such as a fluorescent light may be arranged, and an optical shutter such as liquid crystal elements or PLZT (Pb, La, Zr, Ti) elements arranged in a row may be provided at a side of emergence of the back light. In other words, it is possible to form the plurality of blinking sections by combining one light emitting element and the optical shutter which is arranged in a row.

In the embodiments described above, the LED units 40 and 240 (exposure units) have mainly been formed of the LED head 41 (exposing member) and the supporting frames 42 and 242. However, the structure of the exposure unit of the present invention is not restricted particularly. For instance, the exposing member and the supporting frame may be formed integrally as one component.

In the embodiments described above, the photoconductive drum 53 has been cited as an example of the photoconductive body. However, the present invention is not restricted to the photoconductive drum as a photoconductive body, and the photoconductive body may be a photosensitive belt for example.

In the embodiments described above, the color printers 1 and 201 have been shown as examples of an image forming apparatus. However, the present invention is not restricted to a color printer only, and it may be a color copying machine or a color multi-function device. Moreover, in the embodiments described above, an image forming apparatus (the color printers 1 and 201) in which a formation of a color image is possible has been shown. However, the present invention is not restricted to such image forming apparatus, and it may be a printer, a copying machine, or a multi-function device which forms a monochrome (black and white) image.

In the present invention, "between the first positioning member and the second positioning member in the optical axial direction" include a same position (overlapping or superimposed position) as the first positioning member or the second positioning member. Moreover, "in the triangular-shaped area defined by the first positioning member, the second positioning member, and the third positioning member" include a position overlapping with the three sides of a triangle when viewed from the movement direction of the photoconductive body. Furthermore, "within the range of the outer frame of the area of a surface contact of the exposure unit and the fourth positioning member" include a position overlapping with the outer frame when viewed from the movement direction of the photoconductive body.

What is claimed is:

1. An image forming apparatus comprising:

a photoconductive body on which an electrostatic latent image is configured to be formed;

an exposure unit including a plurality of blinking sections each of which being configured to emit a light to expose the photoconductive body;

a first pressing member configured to press the exposure unit toward the photoconductive body;

a first positioning member configured to be brought into contact with the exposure unit to position the exposure unit in a movement direction of a portion, of the photoconductive body, facing the exposure unit;

a second positioning member which is arranged closer to the photoconductive body than the first positioning member in an optical axis direction of the light, the second positioning member configured to make contact with the exposure unit and to position the exposure unit in the movement direction; and a second pressing member configured to press the exposure unit toward the second positioning member, wherein one of the first positioning member and the second positioning member is arranged at an upstream side in the movement direction with respect to the exposure unit, and the other of the first positioning member and the second positioning member is arranged at a downstream side in the movement direction with respect to the exposure unit;

wherein a portion, of the second pressing member, at which the second pressing member presses the exposure unit is positioned at a first position or a second position the first position facing both of the second positioning member and the exposure unit, and a second position being closer to the photoconductive body than the second positioning member; and wherein a point of action at which the first pressing member presses the exposure unit is located at a position closer to the photoconductive body than the first positioning member in the optical axis direction.

2. The image forming apparatus according to claim 1, wherein the point of action is positioned between the second positioning member and the first positioning member in the optical axis direction.

3. The image forming apparatus according to claim 2, wherein the first positioning member and the second positioning member are arranged at the upstream side or the downstream side in the movement direction with respect to the exposure unit, and a portion of the second pressing member configured to press the exposure unit is positioned between the first positioning member and the second positioning member in the optical axis direction.

4. The image forming apparatus according to claim 3, further comprising a third positioning member configured to be brought into contact with the exposure unit to position the exposure unit in the movement direction, wherein the exposure unit has an elongated shape, and the first positioning member and the second positioning member are arranged at one end in a longitudinal direction of the exposure unit, and the third positioning member is arranged to be located at the other end in the longitudinal direction of the exposure unit, the third positioning member being located at a side same as both of the first positioning member and the second positioning member with respect to an upstream side and a downstream side in the movement direction, and the third positioning member being located between the second positioning member and the first positioning member in the optical axis direction, and the point of action is positioned in a triangular-shaped area defined by the first positioning member, the second positioning member, and the third positioning member.

5. The image forming apparatus according to claim 1, further comprising a third positioning member configured to be brought into contact with the exposure unit to position the exposure unit in the movement direction, wherein the exposure unit has an elongated shape, and the first positioning member and the second positioning member are arranged at one end in a longitudinal direction of the exposure unit, and the third positioning member is arranged to be located at the other end in the longitudinal direction of the exposure unit, the third positioning member being located at a side same as the second positioning member with respect to an upstream side and a downstream side in the movement direction, and the third positioning member being located between the second positioning member and the first positioning member, in the optical axis direction, and the point of action is positioned in a triangular-shaped area defined by the first positioning member, the second positioning member, and the third positioning member.

6. The image forming apparatus according to claim 1, wherein the exposure unit has an exposing member which has the plurality of blinking sections, and a supporting frame which supports the exposing member; and the point of action is at the supporting frame, and the first positioning member and the second positioning member are configured to be brought into contact with the supporting frame.

* * * * *